US012439996B2

(12) United States Patent
Sakamoto

(10) Patent No.: US 12,439,996 B2
(45) Date of Patent: Oct. 14, 2025

(54) SHOE SOLE AND SHOE

(71) Applicant: ASICS CORPORATION, Kobe (JP)

(72) Inventor: Masanori Sakamoto, Kobe (JP)

(73) Assignee: ASICS CORPORATION, Kobe (JP)

( * ) Notice: Subject to any disclaimer, the term of this patent is extended or adjusted under 35 U.S.C. 154(b) by 18 days.

(21) Appl. No.: 18/154,799

(22) Filed: Jan. 14, 2023

(65) Prior Publication Data

US 2023/0225452 A1 Jul. 20, 2023

(30) Foreign Application Priority Data

Jan. 17, 2022 (JP) ..... 2022-004976

(51) Int. Cl.
*A43B 13/18* (2006.01)
*A43B 13/12* (2006.01)

(52) U.S. Cl.
CPC ..... *A43B 13/181* (2013.01); *A43B 13/125* (2013.01)

(58) Field of Classification Search
CPC ..... A43B 13/125; A43B 13/181
See application file for complete search history.

(56) References Cited

U.S. PATENT DOCUMENTS 2,432,533 A * 12/1947 Margolin ..... A43B 7/06 36/3 B
4,292,375 A * 9/1981 Ko ..... B21D 26/055 244/119
7,089,690 B2 * 8/2006 Krstic ..... A43B 23/028 36/3 R
10,881,167 B2 * 1/2021 Jeng ..... A43B 13/181
11,116,284 B2 * 9/2021 Campos, II ..... A43B 13/206
11,399,593 B2 * 8/2022 Cross ..... A43B 13/188
(Continued)

FOREIGN PATENT DOCUMENTS

EP 3841905 A1 * 6/2021 ..... A43B 13/023
JP 2017-527637 A 9/2017
(Continued)

OTHER PUBLICATIONS

The extended European search report issued by the European Patent Office on May 19, 2023, which corresponds to European Patent Application No. 23151329.2-1015 and is related to U.S. Appl. No. 18/154,799.

*Primary Examiner* — Heather Mangine
*Assistant Examiner* — Raquel M. Weis
(74) *Attorney, Agent, or Firm* — Studebaker Brackett PLLC

(57) ABSTRACT

A shoe sole includes a resilient member, and has a bottom surface as a ground contact surface and a top surface. The resilient member has a three-dimensional shape formed by a wall having an outer shape defined by a pair of parallel flat or curved surfaces, and may buckle when the resilient member receives a compressive stress applied in a normal direction to the bottom surface. In the shoe sole, when a load is applied to the shoe sole in a gradually increasing manner such that a compressive stress is applied to the resilient member in the normal direction, the resilient member starts to buckle when a stress applied to the resilient member is within a range of 0.05 MPa or more and 0.55 MPa or less and a strain of the resilient member in the normal direction is within a range of 10% or more and 60% or less.

15 Claims, 26 Drawing Sheets

(56) References Cited

U.S. PATENT DOCUMENTS

2004/0107601 A1* 6/2004 Schmid ..... A43B 13/181 36/28
2012/0021167 A1* 1/2012 Plant ..... A41D 19/01523 428/116
2012/0180341 A1* 7/2012 Crowley, II ..... A43B 13/223 36/83
2012/0315456 A1* 12/2012 Scarpa ..... B32B 3/12 428/221
2014/0202031 A1* 7/2014 Seo ..... A43B 13/127 36/28
2015/0230548 A1* 8/2015 Cross ..... A43B 3/0073 36/104
2015/0245685 A1* 9/2015 Cross ..... A43B 1/0009 12/146 B
2016/0058121 A1* 3/2016 Langvin ..... A43B 13/28 36/103
2016/0157557 A1* 6/2016 Cross ..... A43B 13/223 36/25 R
2016/0157558 A1* 6/2016 Cross ..... A43B 13/187 36/25 R
2018/0049514 A1* 2/2018 Guyan ..... A43B 13/181
2018/0228401 A1* 8/2018 Schwartz ..... A43B 7/1415
2018/0264719 A1* 9/2018 Rolland ..... G03F 7/16
2018/0317600 A1* 11/2018 Campos ..... A43B 13/187
2019/0231018 A1* 8/2019 Boutin ..... A42B 3/124
2019/0320759 A1* 10/2019 Conrad ..... A43B 13/181
2019/0357621 A1* 11/2019 Nauman ..... A61G 5/1045
2020/0068988 A1* 3/2020 Hsiao ..... B29D 35/128
2020/0093221 A1* 3/2020 Caldwell ..... A43B 1/0009
2020/0229538 A1* 7/2020 Yoshinaga ..... B29D 35/00
2020/0268098 A1* 8/2020 Jeng ..... A43B 13/181
2020/0281313 A1* 9/2020 Connell ..... A43B 13/188
2021/0186152 A1* 6/2021 Kumar ..... A43B 13/125
2021/0195989 A1 7/2021 Iwasa et al.
2021/0195995 A1* 7/2021 Sakamoto ..... A43B 7/32
2022/0275845 A1* 9/2022 Kabaria ..... F16F 7/121
2023/0225452 A1* 7/2023 Sakamoto ..... A43B 13/125 36/25 R
2023/0309652 A1* 10/2023 Sakamoto ..... A43B 7/143 36/25 R

FOREIGN PATENT DOCUMENTS

JP 2021-186337 A 12/2021
WO 2015/200201 A1 12/2015

* cited by examiner

| | COMPARATIVE EXAMPLE 1 | COMPARATIVE EXAMPLE 2 | COMPARATIVE EXAMPLE 3 | COMPARATIVE EXAMPLE 4 |
|---|---|---|---|---|
| SPECIFIC GRAVITY [g/cm$^3$] | 0.175 | 0.259 | 0.130 | 0.110 |
| NORMALIZED AER [J/cm$^3$] | 0.031 | 0.045 | 0.042 | 0.044 |
| ENERGY RETURN RATE [%] | 74.1 | 93.4 | 84.2 | 88.4 |

| | COMPARATIVE EXAMPLE 2 | EXAMPLE 1 | EXAMPLE 2 |
|---|---|---|---|
| SPECIFIC GRAVITY [g/cm$^3$] | 0.259 | 0.215 | 0.168 |
| NORMALIZED AER [J/cm$^3$] | 0.045 | 0.054 | 0.047 |
| ENERGY RETURN RATE [%] | 93.4 | 86.1 | 80.9 |

| | | COMPARATIVE EXAMPLE 2 | VERIFICATION EXAMPLE 1 |
|---|---|---|---|
| NORMALIZED AER [J/cm$^3$] (WHEN MAXIMUM PRESSURE IS 0.25 [MPa]) | | 0.045 | 0.054 |
| ENERGY RETURN RATE [%] | | 93.4 | 80 (ASSUMPTION) |
| BUCKLING START POINT | STRESS σ [MPa] | 0.04 | 0.125 |
| | STRAIN ε [%] | 2.5 | 19 |

| | | VERIFICATION EXAMPLE 2 | VERIFICATION EXAMPLE 3 | VERIFICATION EXAMPLE 4 | VERIFICATION EXAMPLE 5 | VERIFICATION EXAMPLE 6 |
|---|---|---|---|---|---|---|
| OCCUPIED VOLUME RATE [%] | | 20 | 20 | 20 | 20 | 20 |
| ELASTIC MODULUS OF BASE MATERIAL [MPa] | | 1 | 4 | 12 | 30 | 50 |
| NORMALIZED AER [J/cm$^3$] (WHEN MAXIMUM PRESSURE IS 0.55 [MPa]) | | 0.035 | 0.068 | 0.083 | 0.155 | 0.027 |
| ENERGY RETURN RATE [%] | | 80 (ASSUMPTION) | 80 (ASSUMPTION) | 80 (ASSUMPTION) | 80 (ASSUMPTION) | 80 (ASSUMPTION) |
| BUCKLING START POINT | STRESS σ [MPa] | 0.016 | 0.066 | 0.197 | 0.492 | 0.820 |
| | STRAIN ε [%] | 19 | 19 | 19 | 19 | 19 |

| | | COMPARATIVE EXAMPLE 2 | VERIFICATION EXAMPLE 7 |
|---|---|---|---|
| NORMALIZED AER [J/cm$^3$] (WHEN MAXIMUM PRESSURE IS 0.25 [MPa]) | | 0.045 | 0.047 |
| ENERGY RETURN RATE [%] | | 93.4 | 80 (ASSUMPTION) |
| BUCKLING START POINT | STRESS σ [MPa] | 0.04 | 0.123 |
| | STRAIN ε [%] | 2.5 | 18 |

SHOE SOLE AND SHOE

This nonprovisional application is based on Japanese Patent Application No. 2022-004976 filed on Jan. 17, 2022 with the Japan Patent Office, the entire contents of which are hereby incorporated by reference.

BACKGROUND OF THE INVENTION

Field of the Invention

The present invention relates to a shoe sole including a resilient member and a shoe including the shoe sole.

Description of the Background Art

A shoe sole including a shock absorber and a shoe including the shoe sole have conventionally been known. The shock absorber is provided in the shoe sole for the purpose of alleviating the impact received on contact with the ground, and is generally often formed of a solid body or a hollow body made of resin or rubber.

For example, U.S. Patent Publication No. 2020/0281313 discloses a shoe configured such that a shock absorber formed of a hollow body made of resin is disposed between a highly rigid plate embedded in a shoe sole and an outsole defining a ground contact surface of the shoe sole.

In recent years, there has been developed a shoe having a shoe sole including an area having a lattice structure or a web structure to thereby enhance the shock absorbing performance in terms not only of material but also of structure. A shoe having a shoe sole including an area having a lattice structure is disclosed, for example, in U.S. Patent Publication No. 2018/0049514.

Further, Japanese National Patent Publication No. 2017-527637 explains that a three-dimensional object manufactured by a three-dimensional additive manufacturing method can be manufactured by adding a thickness to a geometrical surface structure, such as a polyhedron or a triply periodic minimal surface having a cavity therein, and discloses that the three-dimensional object is formed of an elastic material and thereby can be applicable as a shock absorber, for example, to a shoe sole.

SUMMARY OF THE INVENTION

This type of shock absorber exhibits a shock absorbing function when a load is applied to the shock absorber (i.e., when a foot comes into contact with the ground). Thus, conventionally, shock absorbers have been developed for the purpose of maximizing the shock absorbing performance during application of load.

On the other hand, shock absorbers exhibit a resilience function during reduction of load (i.e., when a foot pushes off from the ground). Thus, if the resilience performance achieved during reduction of load can be maximized while applying a shock absorber as a resilient member, high propulsive force can be achieved during running.

However, conventionally, the above-described attempt has actually hardly been taken into consideration. In particular, a shoe sole enhanced in resilience performance in terms not only of material but also of structure and a shoe including the shoe sole have not sufficiently been put into practical use.

Thus, the present invention has been made in view of the above-described problem, and it is an object of the present invention to provide: a shoe sole including a resilient member enhanced in resilience performance to allow high propulsive force to be achieved during running; and a shoe including the shoe sole.

A shoe sole according to the present invention includes a resilient member and has a bottom surface serving as a ground contact surface and a top surface located opposite to the bottom surface. The resilient member has a three-dimensional shape formed by a wall having an outer shape defined by a pair of parallel flat or curved surfaces, and may buckle when the resilient member receives a compressive stress applied in a normal direction to the bottom surface. In the shoe sole according to the present invention, when a load is applied to the shoe sole in a gradually increasing manner such that a compressive stress is applied to the resilient member in the normal direction, the resilient member starts to buckle in a state in which a stress applied to the resilient member is within a range of 0.05 MPa or more and 0.55 MPa or less and a strain of the resilient member in the normal direction is within a range of 10% or more and 60% or less.

A shoe according to the present invention includes: the shoe sole according to the present invention; and an upper provided above the shoe sole.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1A:
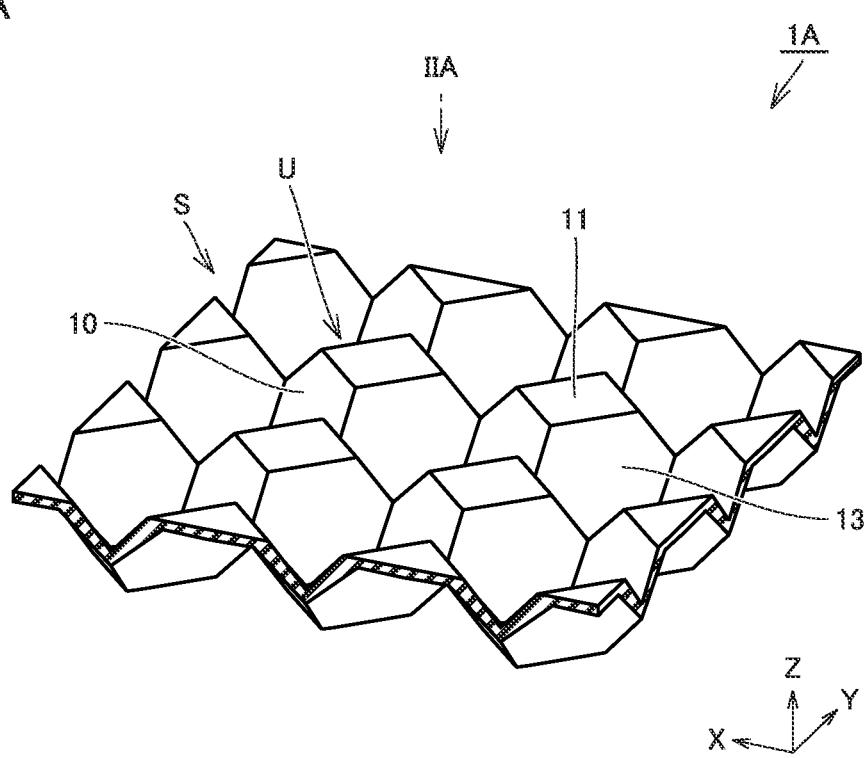
FIG. 1A is a perspective view of a resilient member having basically the same structure as a resilient member included in a shoe sole according to an embodiment.

The following describes embodiments of the present invention in detail with reference to the accompanying drawings. In the embodiments described below, the same or common portions are denoted by the same reference characters, and the description thereof will not be repeated.

<Resilient Member Having Basically the Same Structure as Resilient Member Included in Shoe Sole According to Embodiment>

Figure 1B:
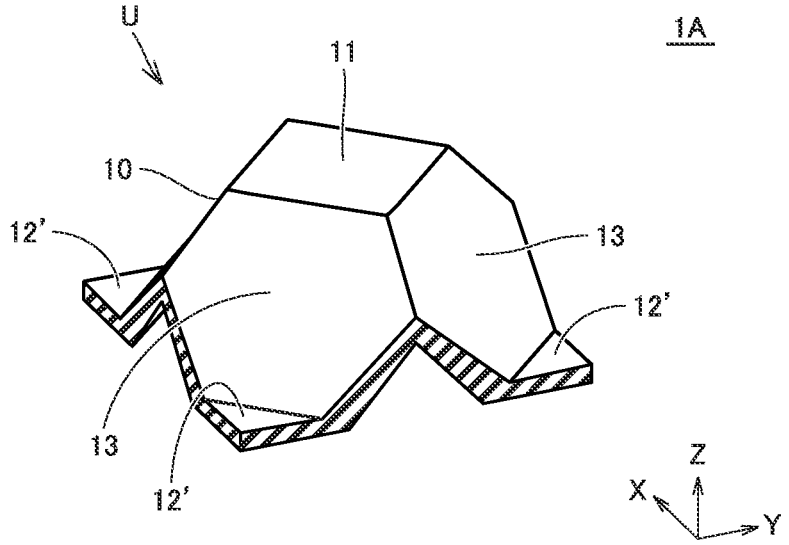
FIG. 1B is a perspective view of a unit structure body forming the resilient member shown in FIG. 1A.
Figure 2A:
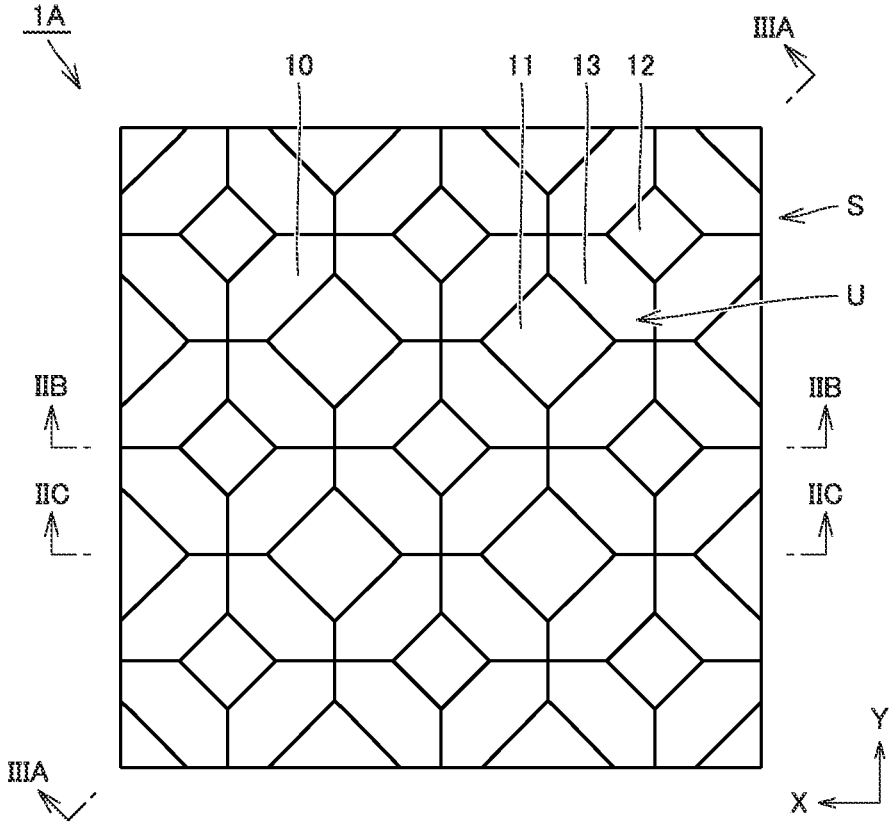
FIG. 2A is a plan view of the resilient member shown in FIG. 1A.
Figure 2B:
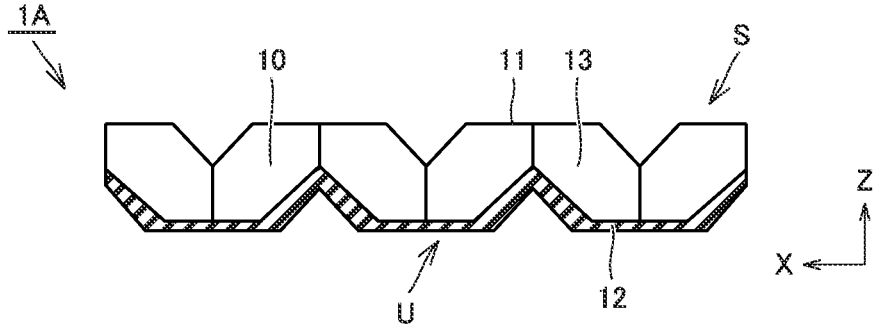
FIGS. 2B and 2C each are a cross-sectional view of the resilient member shown in FIG. 1A.
Figure 2C:
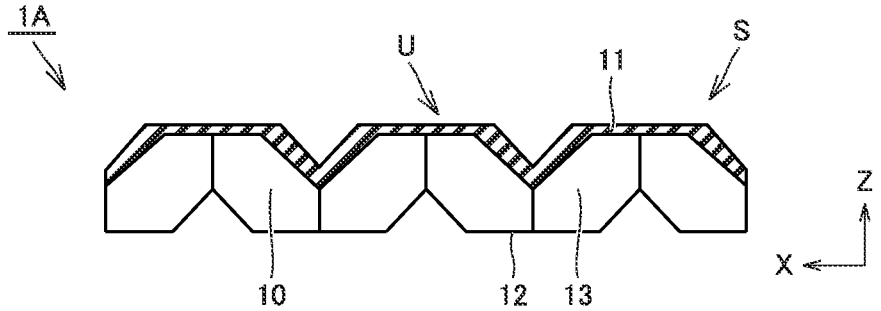

FIG. 1A is a perspective view of a resilient member having basically the same structure as a resilient member included in a shoe sole according to an embodiment, and FIG. 1B is a perspective view of a unit structure body forming the resilient member. FIG. 2A is a plan view of the resilient member shown in FIG. 1A when viewed in a direction indicated by an arrow IIA shown in FIG. 1A, and FIGS. 2B and 2C are cross-sectional views taken along lines IIB-IIB and IIC-IIC, respectively, shown in FIG. 2A. Before describing a shoe sole according to the present embodiment and a shoe including the shoe sole, the following describes a configuration of a resilient member 1A conforming in structure to the resilient member included in the shoe sole with reference to FIGS. 1A, 1B, and 2A to 2C.

As shown in FIGS. 1A and 2A to 2C, the resilient member 1A includes a three-dimensional structure S having a plurality of unit structure bodies U. Each of the plurality of unit structure bodies U has a three-dimensional shape formed by a wall 10 having an outer shape defined by a pair of parallel flat surfaces (see FIG. 1B). Thereby, the three-dimensional structure S also has a three-dimensional shape formed by the wall 10 having an outer shape defined by a pair of parallel flat surfaces.

The unit structure body U has a structure obtained by adding a thickness to a base structure unit having a geometrical surface structure. More specifically, the unit structure body U is formed by adding a thickness to each of divided structure units obtained by dividing a structure unit into two in one of its orthogonal three-axis directions, the structure unit being formed of a plurality of flat surfaces disposed to intersect with each other so as to be hollow inside.

In this case, in the unit structure body U shown in FIG. 1B, the above-mentioned surface structure is a Kelvin structure, and the unit structure body U is formed by adding a thickness to each of divided structure units obtained by dividing a structure unit having a Kelvin structure into two in a height direction (in a Z-axis direction shown in the figure) among the orthogonal three-axis directions.

More specifically, the unit structure body U includes; one upper wall portion 11; four divided lower wall portions 12'; and four upright wall portions 13 each connecting the upper wall portion 11 and a corresponding one of the lower wall portions 12'. Each of the upright wall portions 13 extends to intersect with the upper wall portion 11 and a corresponding one of the lower wall portions 12', and is connected on its both side ends to adjacent upright wall portions 13. Thus, the four upright wall portions 13 entirely form an annular shape. Note that each of the upper wall portion 11, the lower wall portions 12', and the upright wall portions 13 has a flat plate shape.

Each of the four divided lower wall portions 12' included in one unit structure body U is arranged continuously to, and thereby integrated with, one of the lower wall portions 12' included in another unit structure body U adjacent to the one unit structure body U. Thus, in the three-dimensional structure S, each of the lower wall portions 12' included in each of four unit structure bodies U adjacent to each other is arranged continuously to an adjacent lower wall portion 12' included in a corresponding one of these four unit structure bodies U, to thereby form one lower wall portion 12 substantially similar in shape to the above-mentioned one upper wall portion 11 (see FIG. 2A and the like).

The resilient member 1A according to the present embodiment is intended to exhibit a resilience function in the above-mentioned height direction. Thus, as shown in FIGS. 1A and 2A to 2C, the plurality of unit structure bodies U are repeatedly arranged in a regular and continuous manner in each of a width direction (an X direction shown in the figure) and a depth direction (a Y direction shown in the figure)

among the orthogonal three-axis directions. Thereby, the three-dimensional structure S has a structure in which upward protruding portions and downward protruding portions are alternately arranged in a plan view. FIGS. 1A and 2A to 2C each show only three unit structure bodies U arranged adjacent to each other in the width direction and the depth direction.

In this case, in the illustrative description of the present embodiment, the resilient member 1A is formed of a large number of unit structure bodies U arranged in the width direction and the depth direction, but the number of unit structure bodies U repeatedly arranged in the width direction and the depth direction is not particularly limited. Specifically, the resilient member may be formed by arranging two or more unit structure bodies U in only one of the width direction and the depth direction, or may be formed of only a single unit structure body U.

While a method of manufacturing the resilient member 1A is not particularly limited, the resilient member 1A can be manufactured, for example, by molding such as injection molding using a mold, cast molding, sheet molding, additive manufacturing using a three-dimensional additive manufacturing apparatus; or the like. In particular, the above-described resilient member 1A has a relatively simple shape, and therefore, can be manufactured easily by molding using a mold. This eliminates the need to perform additive manufacturing using a three-dimensional additive manufacturing apparatus or molding using a complicated mold, so that the manufacturing cost can be significantly reduced. Further, by manufacturing the resilient member 1A by molding using a mold, the resilient member 1A can be manufactured even with a material type by which the resilient member 1A cannot be manufactured by additive manufacturing using a three-dimensional additive manufacturing apparatus. This increases the degree of freedom for material selection, and thus, a resilient member having higher resilience performance can be implemented.

The material of the resilient member 1A may be basically any material as long as it has appropriate elastic force, but is preferably a resin material or a rubber material. More specifically, when the resilient member 1A is made of resin, for example, the material of the resilient member 1A may be a polyolefin resin, ethylene-vinyl acetate copolymer (EVA), polyamide-based thermoplastic elastomer (TPA, TPAE), thermoplastic polyurethane (TPU), and polyester-based thermoplastic elastomer (TPEE). On the other hand, when the resilient member 1A is made of rubber, for example, butadiene rubber may be used.

The resilient member 1A can be formed of a polymer composition. In that case, examples of polymer to be contained in the polymer composition include olefinic polymers such as olefinic elastomers and olefinic resins. Examples of the olefinic polymers include polyolefins such as polyethylene (e.g., linear low density polyethylene (LLDPE), high density polyethylene (HDPE), and the like), polypropylene, ethylene-propylene copolymer, propylene-1-hexene copolymer, propylene-4-methyl-1-pentene copolymer, propylene-1-butene copolymer, ethylene-1-hexene copolymer, ethylene-4-methyl-pentene copolymer, ethylene-1-butene copolymer, 1-butene-1-hexene copolymer, 1-butene-4-methyl-pentene, ethylene-methacrylic acid copolymer, ethylene-methyl methacrylate copolymer, ethylene-ethyl methacrylate copolymer, ethylene-butyl methacrylate copolymer, ethylene-methyl acrylate copolymer, ethylene-ethyl acrylate copolymer, ethylene-butyl acrylate copolymer, propylene-methacrylic acid copolymer, propylene-methyl methacrylate copolymer, propylene-ethyl methacrylate copolymer, propylene-butyl methacrylate copolymer, propylene-methyl acrylate copolymer, propylene-ethyl acrylate copolymer, propylene-butyl acrylate copolymer, ethylene-vinyl acetate copolymer (EVA), propylene-vinyl acetate copolymer, and the like.

The polymer may be an amide-based polymer such as an amide-based elastomer and an amide-based resin. Examples of the amide-based polymer include polyamide 6, polyamide 11, polyamide 12, polyamide 66, polyamide 610, and the like.

The polymer may be an ester-based polymer such as an ester-based elastomer and an ester-based resin. Examples of the ester-based polymer include polyethylene terephthalate and polybutylene terephthalate.

The polymer may be a urethane-based polymer such as a urethane-based elastomer and a urethane-based resin. Examples of the urethane-based polymer include polyester-based polyurethane and polyether-based polyurethane.

The polymer may be a styrene-based polymer such as a styrene-based elastomer and a styrene-based resin. Examples of the styrene-based elastomer include styrene-ethylene-butylene copolymer (SEB), styrene-butadiene-styrene copolymer (SBS), a hydrogenated product of SBS (styrene-ethylene-butylene-styrene copolymer (SEBS)), styrene-isoprene-styrene copolymer (SIS), a hydrogenated product of SIS (styrene-ethylene-propylene-styrene copolymer (SEPS)), styrene-isobutylene-styrene copolymer (SIBS), styrene-butadiene-styrene-butadiene (SBSB), styrene-butadiene-styrene-butadiene-styrene (SBSBS), and the like. Examples of the styrene-based resin include polystyrene, acrylonitrile styrene resin (AS), and acrylonitrile butadiene styrene resin (ABS).

Examples of the polymer include acrylic polymers such as polymethylmethacrylate, urethane-based acrylic polymers, polyester-based acrylic polymers, polyether-based acrylic polymers, polycarbonate-based acrylic polymers, epoxy-based acrylic polymers, conjugated diene polymer-based acrylic polymers and hydrogenated products thereof, urethane-based methacrylic polymers, polyester-based methacrylic polymers, polyether-based methacrylic polymers, polycarbonate-based methacrylic polymers, epoxy-based methacrylic polymers, conjugated diene polymer-based methacrylic polymers and hydrogenated products thereof, polyvinyl chloride-based resins, silicone-based elastomers, butadiene rubber (BR), isoprene rubber (IR), chloroprene (CR), natural rubber (NR), styrene-butadiene rubber (SBR), acrylonitrile-butadiene rubber (NBR), butyl rubber (IIR), and the like.

In this case, when the material of the resilient member 1A is selected, it is preferable to pay attention to a loss tangent that is generally referred to as tan δ, and it is preferable to select a material whose tan δ at 25° C. is smaller than 0.15, preferably smaller than 0.10, and more preferably smaller than 0.05.

This tan δ is used as an indicator of energy loss resulting from deformation of the material. Also, by using a base material whose tan δ having a small value, energy loss occurring inside the base material during compressive deformation can be suppressed, so that higher resilience performance can be expected to be achieved. For measuring tan δ, a dynamic viscoelasticity measuring method defined in Testing Standards such as JIS K7244-4 can be used.

Figure 3A:
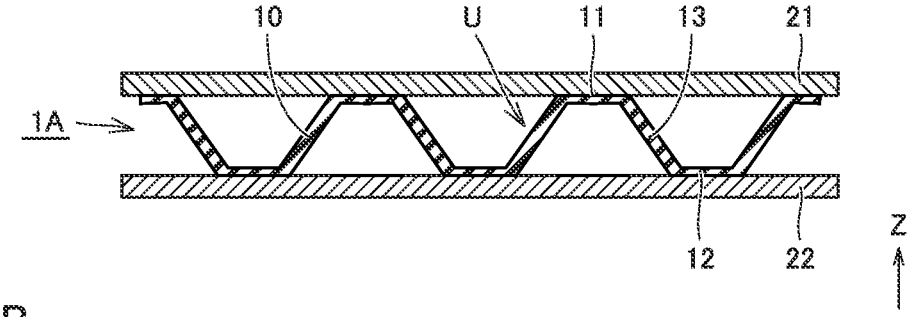
FIGS. 3A and 3B each schematically show buckling that may occur in the resilient member shown in FIG. 1A.
Figure 3B:
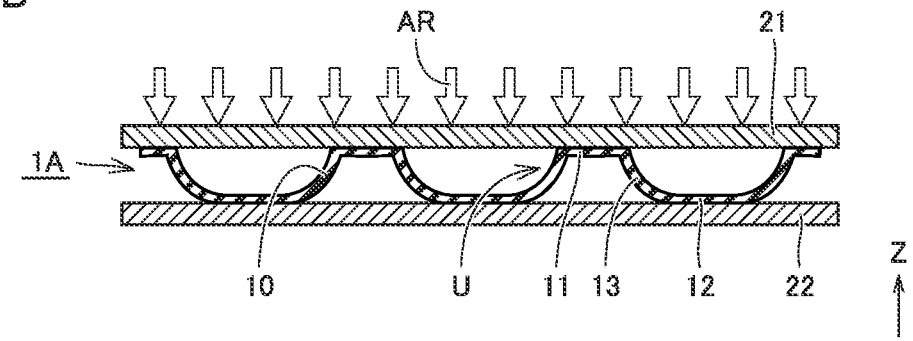

FIGS. 3A and 3B each schematically show buckling that may occur in the resilient member shown in FIG. 1A. Referring to FIGS. 3A and 3B, the following describes buckling that may occur in the resilient member 1A. Note that the cross section of the resilient member 1A shown in each of FIGS. 3A and 3B is taken along a line IIIA-IIIA shown in FIG. 2A.

As shown in FIG. 3A, for example, in the state in which the resilient member 1A is sandwiched in the height direction (in the Z-axis direction shown in the figure) between a pair of highly-rigid and flat-plate-shaped upper member 21 and lower member 22, the upper member 21 is gradually pressed toward the lower member 22 (i.e., in the direction indicated by arrows AR shown in FIG. 3B). In this case, a load is gradually applied to the resilient member 1A in the height direction, with the result that the resilient member 1A undergoes compressive deformation as shown in FIG. 3B. At this time, due to the structure of the resilient member 1A, the upright wall portion 13 deforms, and then, a load above a certain level is applied to thereby cause buckling in the upright wall portion 13.

On the other hand, when this pressure application is stopped, the load applied to the resilient member 1A in the height direction decreases and disappears. Thereby, the compressive deformation occurring in the resilient member 1A is removed and the resilient member 1A returns to its original shape. At this time, buckling occurring in the resilient member 1A also disappears.

When such compressive deformation is removed, the elastic restoring force of the resilient member 1A applies resilient force to the upper member 21 and the lower member 22 in the direction in which the upper member 21 and the lower member 22 are moved away from each other. The resilient force applied to the upper member 21 and the lower member 22 determines the resilience performance of the resilient member 1A.

Figure 4:
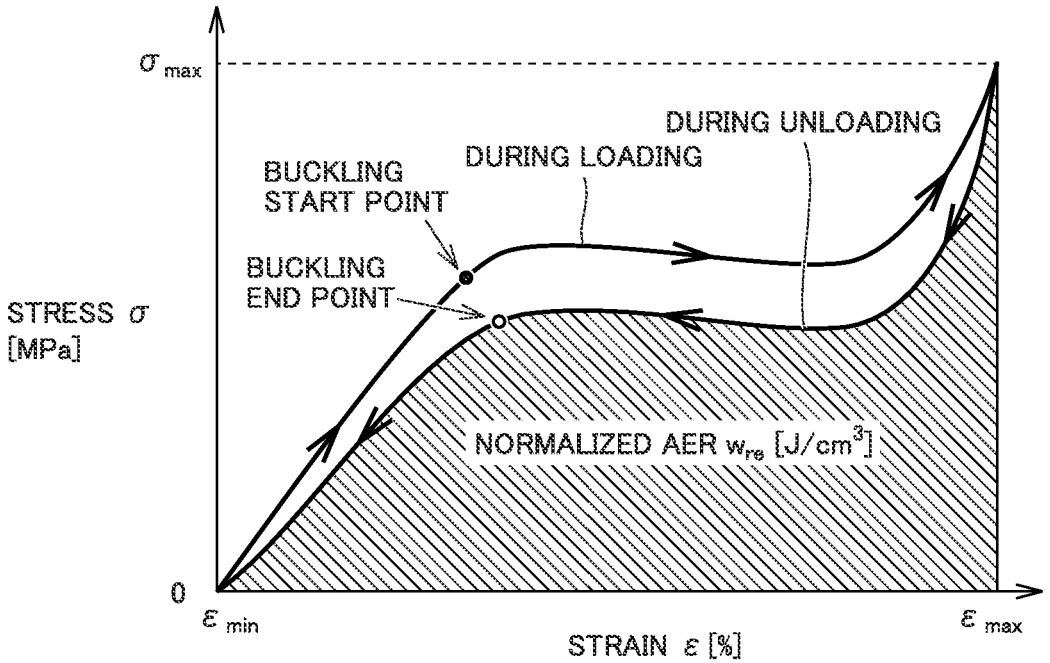
FIG. 4 is a graph showing resilience performance of the resilient member shown in FIG. 1A.
Figure 5:
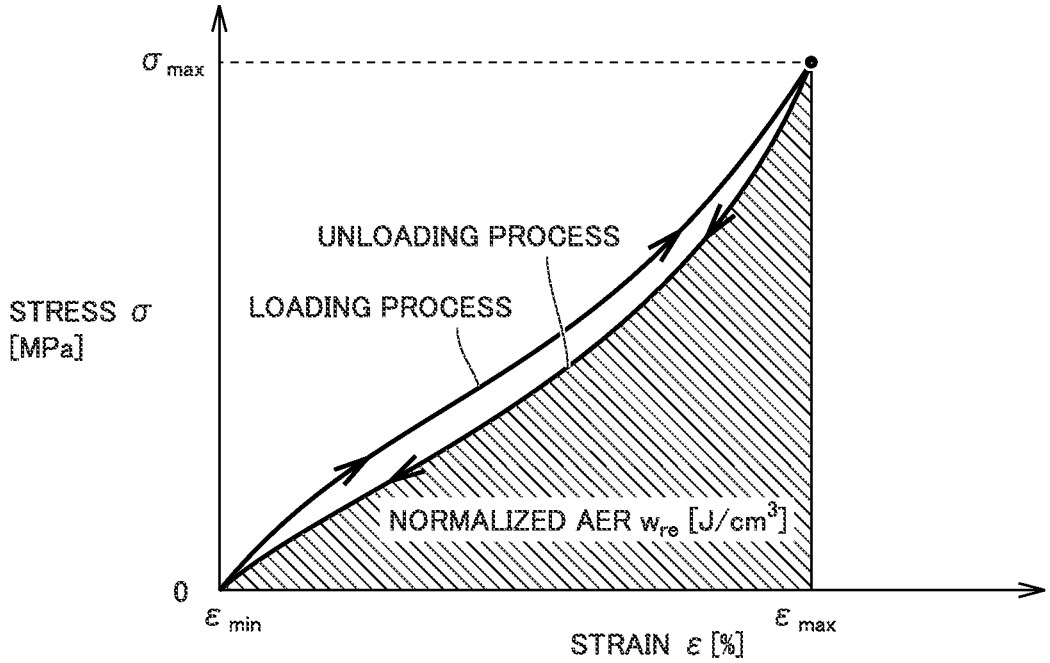
FIG. 5 is a graph showing resilience performance of a commonly-used shock absorber.

FIG. 4 is a graph showing resilience performance of the resilient member shown in FIG. 1A, and FIG. 5 is a graph showing resilience performance of a commonly-used shock absorber. The graphs shown in FIGS. 4 and 5 each are what is called a stress-strain curve that represents the correlation between stress and strain assuming that the vertical axis represents the stress applied to a resilient member (a shock absorber) while the horizontal axis represents the strain of the resilient member (the shock absorber).

As described above, buckling occurs in the resilient member 1A due to its structure in a process in which a load is applied to the resilient member 1A in a gradually increasing manner (hereinafter referred to as a "loading process"). On the other hand, as described above, buckling disappears in the resilient member 1A due to its structure in a process in which the load applied to the resilient member 1A gradually decreases (hereinafter referred to as an "unloading process"). The compressive deformation of the resilient member 1A accompanied with buckling appears as a characteristic curve in the stress-strain curve as described below.

Specifically, as shown in FIG. 4, in the initial stage of the loading process, a stress a increases as a strain c increases, and accordingly, the stress-strain curve rises in an upward right direction. On the other hand, in the middle stage of the loading process, the stress a hardly changes even when the strain a increases, and accordingly, the stress-strain curve extends in a rightward direction. Then, in the final stage of the loading process, the stress a also increases as the strain e increases, and accordingly, the stress-strain curve again rises in the upward right direction.

On the other hand, in the initial stage of the unloading process, also the stress σ decreases as the strain ε decreases, and accordingly, the stress-strain curve falls in a downward left direction. In contrast, in the middle stage of the unloading process, the stress a hardly changes even when the strain a decreases, and accordingly, the stress-strain curve extends in a leftward direction. Then, in the final stage of the unloading process, the stress σ also decreases as the strain ε decreases, and accordingly, the stress-strain curve again falls in the downward left direction.

On the other hand, buckling does not occur in a commonly-used shock absorber due to its structure in the loading process. Thus, the compressive deformation of the shock absorber appears as a characteristic curve in the stress-strain curve as described below.

Specifically, as shown in FIG. 5, from the initial stage to the final stage in the loading process, the stress σ continuously increases as the strain ε increases, and accordingly, the stress-strain curve rises in an upward right direction.

In contrast, from the initial stage to the final stage in the unloading process, the stress σ continuously decreases as the strain ε decreases, and accordingly, the stress-strain curve falls in a downward left direction.

It is known that, regardless of whether or not buckling occurs, a certain level of relevance exists between the stress-strain curve in the loading process and the stress-strain curve in the unloading process. Specifically, the stress-strain curve in the unloading process approximately coincides with a stress-strain curve that is approximately 0.7 times to 0.9 times in the vertical axis direction as the stress-strain curve in the loading process.

In this case, as an indicator indicating superiority or inferiority of the resilience performance, an indicator called a normalized AER (Absolute Energy Return) is applicable. This normalized AER is represented by the area surrounded between the stress-strain curve in the unloading process and the horizontal axis (the area of the diagonally shaded portion in each of the graphs shown in FIGS. 4 and 5), and is represented by the following equation (1) assuming that the normalized AER is defined as "wre". Note that εmax denotes a strain occurring when the stress σ in the unloading process is at the maximum level (i.e., at the level of σmax shown in FIGS. 4 and 5), and εmin denotes a strain occurring when the stress σ in the unloading process is at the minimum level (i.e., when σ=0).

$$w_{re}=\int_{e_{min}}^{e_{max}}\sigma d\varepsilon \tag{1}$$

As the value of the normalized AER is larger, the resilient force to be achieved becomes larger. Therefore, if the resilient member can be configured to achieve higher normalized AER, it becomes possible to increase the propulsive force during running by applying this resilient member to the shoe sole.

In this regard, in the case of the resilient member 1A that buckles during compressive deformation, in the middle stage of the unloading process, the stress-strain curve has a region where the stress hardly changes even when the strain decreases. Thus, if the resilient member 1A can be configured such that buckling starts at a prescribed level of stress and a prescribed level of strain, resilient force greater than that achieved by a commonly-used shock absorber can be achieved.

While the normalized AER is calculated from the stress-strain curve in the unloading process, a certain level of relevance exists between the stress-strain curve in the loading process and the stress-strain curve in the unloading process as described above. Accordingly, if the stress and the strain at which buckling starts can be adjusted as described above, greater resilient force can be achieved.

In this case, the maximum stress applied to the shoe sole during running, which varies depending on the body weight, the body shape, the running method or the like of the wearer, the road surface condition or the like, is about 0.05 MPa to 0.55 MPa (in particular, about 0.05 MPa to 0.25 MPa for marathon, and about 0.25 MPa to 0.55 MPa for short-distance running), more restrictively, about 0.15 MPa to 0.4 MPa (in particular, about 0.15 MPa to 0.25 MPa for marathon, and about 0.25 MPa to 0.4 MPa for short-distance running). Thus, the above-described resilient member 1A needs to be configured such that buckling starts within the above-mentioned stress ranges. In the following description, the stress range of about 0.05 MPa to 0.55 MPa as mentioned above is referred to as a "required stress range" for the sake of convenience.

In other words, in the case of the resilient member that starts buckling at a stress smaller than the required stress range, the above-mentioned normalized AER cannot be expected to be sufficiently increased. Also, in the case of the resilient member that starts buckling at a stress greater than the required stress range, buckling essentially does not occur during running, and thus, the above-mentioned normalized AER cannot be expected to be sufficiently increased.

On the other hand, the strain occurring in the resilient member during running varies depending not only on the body weight, the body shape, the running method, or the like of the wearer, or the road surface condition but also on the shape, the material or the like of the resilient member. In this case, in consideration of the facts that the shock absorbing performance is hardly achieved when the strain is too small and that the shoe sole significantly sinks when the strain is too large, the strain is preferably about 10% to 60%, and more preferably about 10% to 40%.

Therefore, the resilient member 1A needs to be configured such that buckling starts within the above-mentioned strain range. In the following description, the strain range of about 10% to 60% as mentioned above is referred to as a "required strain range" for the sake of convenience.

Based on the viewpoint as described above, the present inventor conducted the following Verification Tests 1 to 4 to verify whether it is possible or not to implement a resilient member capable of maximizing the resilience performance during running when the resilient member is provided in a shoe sole. These Verification Tests 1 to 4 will be hereinafter sequentially described. In the following description, a point at which buckling starts in the loading process will be referred to as a "buckling start point" for the sake of convenience.

<Verification Test 1>

In Verification Test 1, a plurality of shock absorbers used in commonly available shoe soles were prepared, and the resilience performance of each of these shock absorbers was actually measured. A total of four types of shock absorbers according to Comparative Examples 1 to 4 were prepared, and their stress-strain curves were obtained using Autograph AGX-50 kN manufactured by Shimadzu Corporation as a measuring device. As for the test conditions, the compression rate was set at 1%/s, and the maximum pressure was set at 0.25 MPa.

Figure 6:
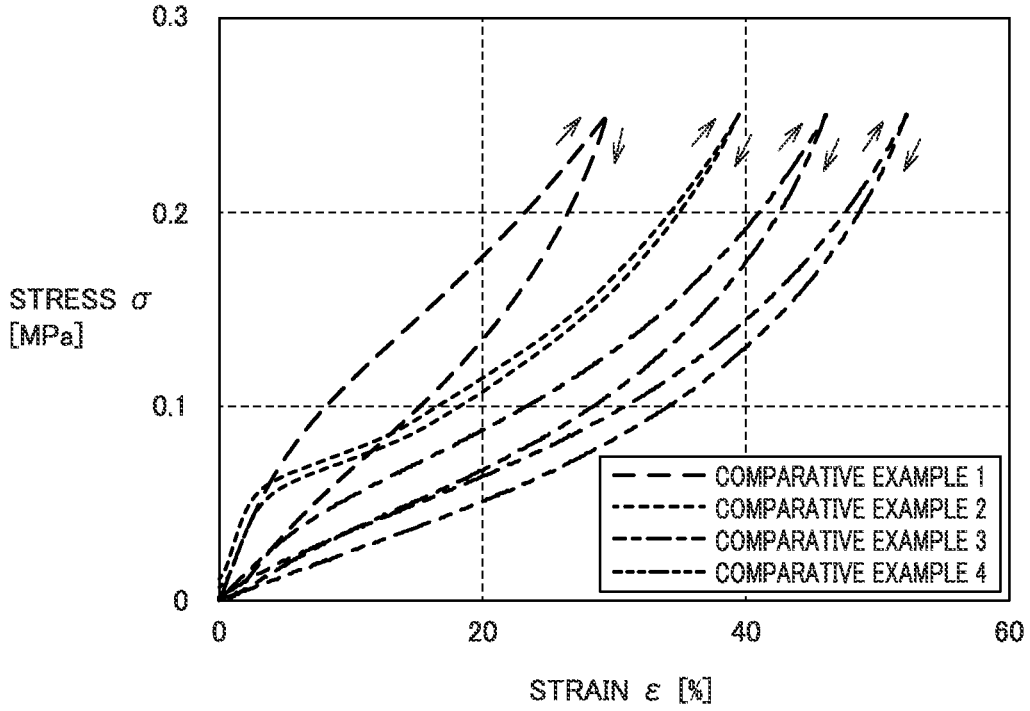
FIG. 6 is a graph showing measurement results of resilience performance of shock absorbers according to Comparative Examples 1 to 4.
Figures 7, 8:
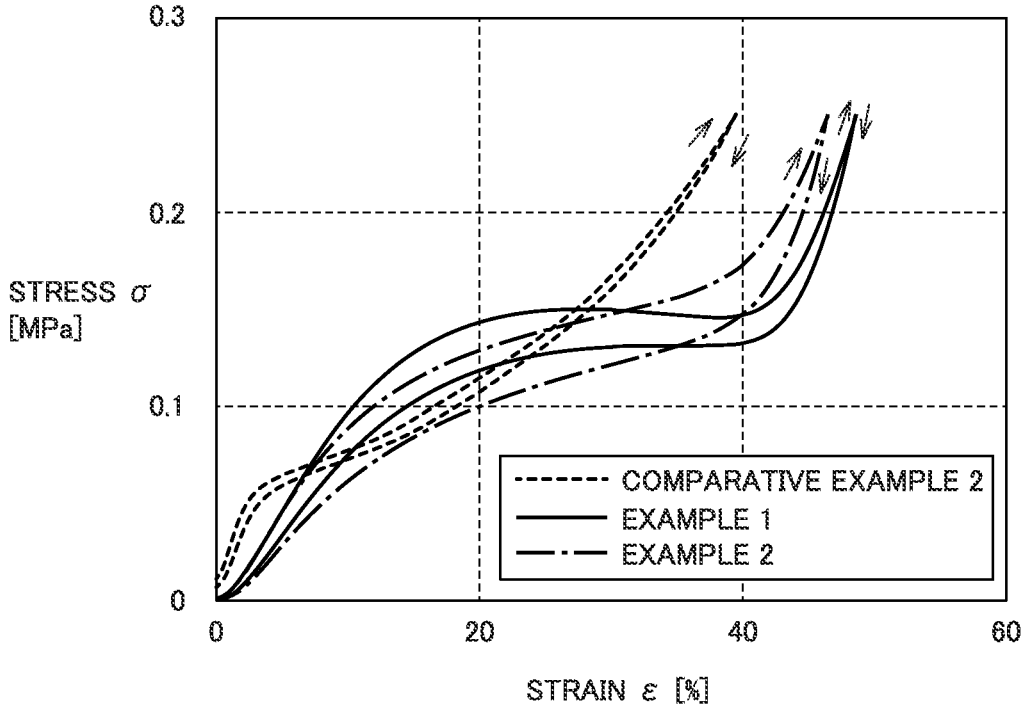
FIG. 7 is a table showing characteristics of the shock absorbers according to Comparative Examples 1 to 4.
FIG. 8 is a graph showing measurement results of resilience performance of a resilient member according to Example 1.

FIG. 6 is a graph showing measurement results of the resilience performance of each of the shock absorbers according to Comparative Examples 1 to 4. FIG. 7 is a table showing the characteristics of the shock absorbers according to Comparative Examples 1 to 4.

As shown in FIG. 6, each of the stress-strain curves of the shock absorbers according to Comparative Examples 1 to 4 conformed to the stress-strain curve of the above-mentioned commonly-used shock absorber (see FIG. 5). In particular, in the case of the shock absorbers according to Comparative Examples 1, 3, and 4, the loading process did not include a region where the stress hardly changed even when the strain increased, like a region included in the above-described stress-strain curve of the resilient member 1A Accordingly, the unloading process also did not include a region where the stress hardly changed even when the strain decreased.

On the other hand, in the case of the shock absorber according to Comparative Example 2, the loading process includes a small region where the stress hardly changes even when the strain increases, and accordingly, the unloading process also includes a small region where the stress hardly changes even when the strain decreases. However, the buckling start point of the shock absorber according to Comparative Example 2 was out of both the required stress range and the required strain range, as will be described later.

In this case, as shown in FIG. 7, the normalized AER of each of the shock absorbers according to Comparative Examples 1 to 4 was 0.045 J/cm$^3$ at the maximum level and 0.031 J/cm$^3$ at the minimum level, and its energy return rate was 93.4% at the maximum level and 74.1% at the minimum level. Note that the energy return rate represents a ratio between: the area surrounded between the stress-strain curve in the loading process and the horizontal axis; and the area surrounded between the stress-strain curve in the unloading process and the horizontal axis (i.e., the normalized AER).

<Verification Test 2>

In Verification Test 2, a plurality of resilient members each having the same structure as that of the above-described resilient member 1A were manufactured by injection molding actually using a mold, and the resilience performance of each of these resilient members was actually measured. A total of two types of resilient members according to Examples 1 and 2 were manufactured, and their stress-strain curves were obtained using Autograph AGX-50 kN manufactured by Shimadzu Corporation as a measuring device. In this case, these two types of resilient members are different only in thickness of the above-mentioned wall 10 (see FIG. 1A and the like) forming each of these resilient members, and accordingly, are also different in specific gravity (see FIG. 9). As for the test conditions, the compression rate was set at 1%/s, and the maximum pressure was set at 0.25 MPa.

Figures 9, 10:
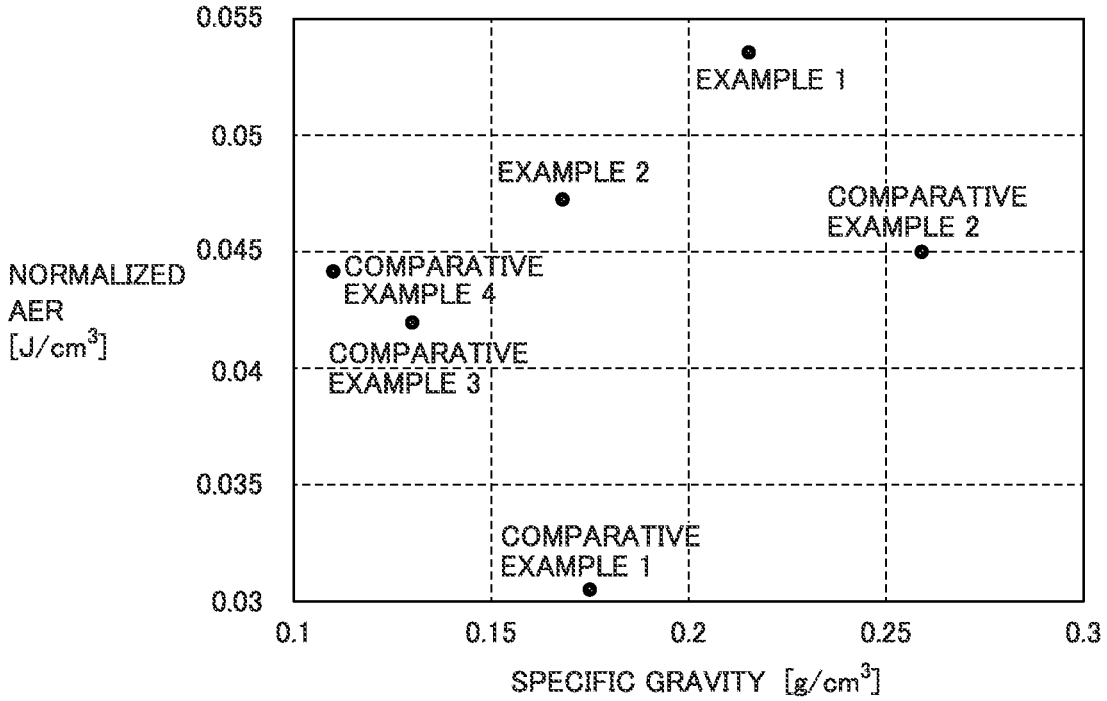
FIG. 9 is a table showing characteristics of resilient members according to Examples 1 and 2.
FIG. 10 is a graph summarizing the characteristics of the resilient members according to Examples 1 and 2 and the shock absorbers according to Comparative Examples 1 to 4.

FIG. 8 is a graph showing the measurement results of the resilience performance of the resilient member according to Example 1, and FIG. 9 is a table showing the characteristics of the resilient members according to Examples 1 and 2. In this case, for comparison, FIGS. 8 and 9 each additionally show the results of Comparative Example 2 in which it was confirmed that the highest resilient force was achieved in the above-described Verification Test 1.

As shown in FIG. 8, the stress-strain curve of the resilient member according to Example 1 conformed to the stress-strain curve of the resilient member 1A (see FIG. 4) described above. In other words, in the case of the resilient member according to Example 1, the loading process included a region where the stress strain hardly changed even when the strain increased, like a region included in the stress-strain curve of the resilient member 1A described above. Accordingly, the unloading process also included a region where the stress hardly changed even when the strain decreased. Although the stress-strain curve of the resilient member according to Example 2 is not shown for convenience of illustration, similar results were observed also in Example 2.

In this case, as shown in FIG. 9, the normalized AER of the resilient member according to Example 1 was 0.054 J/cm$^3$, and its energy return rate was 86.1%. The normalized AER of the resilient member according to Example 2 was 0.047 J/cm$^3$, and its energy return rate was 80.9%.

It was confirmed that the normalized AER of each of the resilient members according to Examples 1 and 2 exceeded the normalized AER of the shock absorber according to Comparative Example 2, and thus, the resilient member 1A having the above-described configuration could achieve high resilience performance.

FIG. 10 is a graph summarizing the characteristics of the resilient members according to Examples 1 and 2 and Comparative Examples 1 to 4. Specifically, in the graph shown in FIG. 10, the vertical axis represents the normalized AER while the horizontal axis represents the specific gravity, and the specific gravity and the normalized AER of each of the resilient members according to Examples 1 and 2 and Comparative Examples 1 to 4 are plotted on the graph.

As shown in FIG. 10, each of the shock absorbers according to Comparative Examples 1, 3, and 4 is relatively low in specific gravity and relatively lightweight and therefore is suitable for application to a shoe sole, but each of these shock absorbers cannot achieve high resilient force as described above and therefore is less suitable for application to a shoe sole required to increase resilient force. Further, the shock absorber according to Comparative Example 2 can achieve relatively high resilient force as described above and therefore is suitable for application to a shoe sole required to increase resilient force, but this shock absorber is relatively high in specific gravity and thus increases the weight of a shoe sole and therefore is less suitable for application to a shoe sole.

In this regard, each of the resilient members according to Examples 1 and 2 can achieve high resilient force exceeding the resilient force of the shock absorber according to Comparative Example 2 as described above, and therefore, is suitable for application to a shoe sole required to increase resilient force. Further, each of the resilient members according to Examples 1 and 2 is lower in specific gravity than the shock absorber according to Comparative Example 2, and therefore, is also suitable for application to a shoe sole.

As compared with the shock absorber according to Comparative Example 2, the resilient member according to Example 1 is expected to be improved in resilient force by about 18% and to be reduced in weight by about 17%.

<Verification Test 3>

In Verification Test 3, a simulation model corresponding to the resilient member according to Example 1 described above was prepared as Verification Example 1, and subjected to a structural analysis using a finite element method (FEM), to thereby calculate a stress-strain curve of the resilient member according to Example 1 formed of the simulation model. Then, it is checked how degree the calculated stress-strain curve conforms to the stress-strain curve actually measured using the resilient member according to Example 1.

Figures 11, 12:
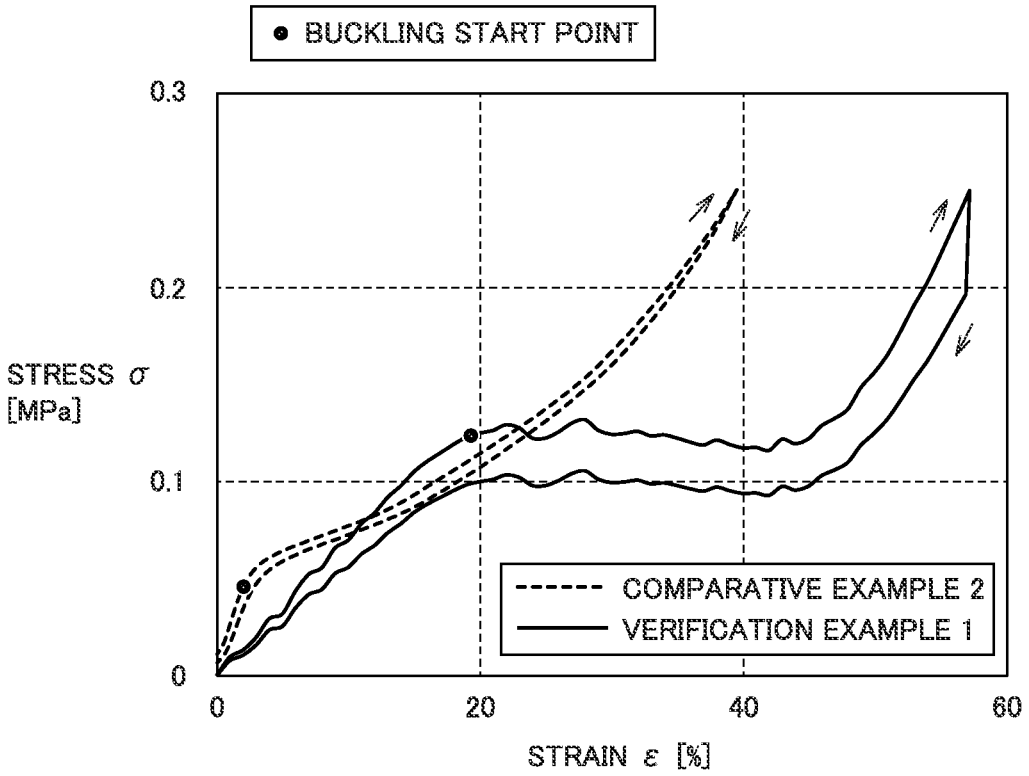
FIG. 11 is a graph showing simulation results of resilience performance of a resilient member according to Verification Example 1.
FIG. 12 is a table showing characteristics of the resilient member according to Verification Example 1.

FIG. 11 is a graph showing simulation results of resilience performance of the resilient member according to Verification Example 1. FIG. 12 is a table showing characteristics of the resilient member according to Verification Example 1. For comparison, FIGS. 11 and 12 each additionally show the results of Comparative Example 2 by which it was confirmed that the highest resilient force was achieved in the above-described Verification Test 1.

As shown in FIG. 11, the stress-strain curve of the resilient member according to Verification Example 1 conformed to the stress-strain curve of the resilient member 1A (see FIG. 4) described above. In other words, in the case of the resilient member according to Verification Example 1, the loading process included a region where the stress hardly changed even when the strain increased, like a region included in the stress-strain curve of the resilient member 1A described above. Accordingly, the unloading process also included a region where the stress hardly changed even when the strain decreased.

In this case, as shown in FIG. 12, the normalized AER of the resilient member according to Verification Example 1 was 0.054 J/cm$^3$ when the energy return rate was assumed to be 80%. The normalized AER of the resilient member according to Verification Example 1 conforms to the normalized AER of the resilient member according to the above-described Example 1, and it was confirmed that the simulation method performed in Verification Test 3 was a roughly appropriate method for predicting the normalized AER.

Further, as shown in FIGS. 11 and 12, the buckling start point was calculated from the stress-strain curve of the resilient member according to Verification Example 1, and the buckling start point was calculated from the stress-strain curve of the resilient member according to Comparative Example 2. The buckling start point was calculated by the following method.

First, the tangent modulus of elasticity at each point is calculated by differentiating the stress $\sigma$ with respect to the strain $\varepsilon$ based on the stress-strain curve. Then, the tangent modulus of elasticity obtained at 1% of the strain $\varepsilon$ is defined as an initial elastic modulus, and the point at which the tangent modulus of elasticity equal to or less than ½ of the initial elastic modulus is obtained for the first time in the loading process is defined as a buckling start point. From the viewpoint of reducing errors, various filtering methods may be applied as required for calculating the buckling start point. The method similar to the above-described method can be used also in the case of calculating the buckling start point from the stress-strain curve obtained by measuring the actually manufactured resilient member (shock absorber).

As a result, it was calculated that the buckling start point of the shock absorber according to Comparative Example 2 was located at a point at which the stress $\sigma$ was 0.04 MPa and the strain $\varepsilon$ was 2.5%, and the buckling start point of the resilient member according to Verification Example 1 was located at a point at which the stress $\sigma$ was 0.125 MPa and the strain s was 19%. In other words, it was confirmed that the buckling start point of the shock absorber according to Comparative Example 2 was out of both the required stress range and the required strain range as described above, whereas the buckling start point of the resilient member according to Verification Example 1 was within both the required stress range and the required strain range.

<Verification Test 4>

In Verification Test 4, a plurality of simulation models of the resilient members having the same structure as that of the resilient member 1A were prepared and subjected to a structural analysis using the above-mentioned finite element method (FEM), to thereby calculate the stress-strain curve, the normalized AER, the buckling start point, and the like of each of the resilient members formed based on the above-mentioned simulation models. In this case, a total of five types of resilient members according to Verification Examples 2 to 6 were prepared based on the simulation models, and these prepared resilient members are different only in elastic modulus of base material.

Figures 13, 14:
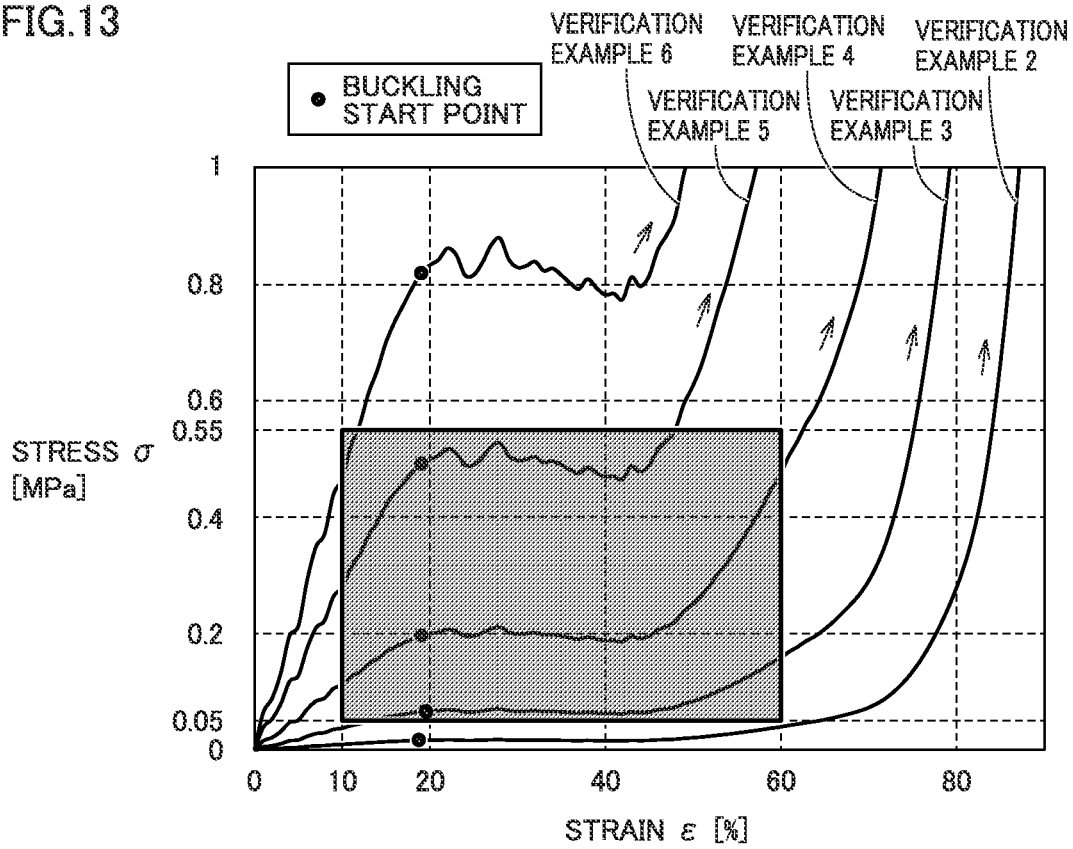
FIG. 13 is a graph showing simulation results of resilience performance of resilient members according to Verification Examples 2 to 6.
FIG. 14 is a table showing characteristics of the resilient members according to Verification Examples 2 to 6.

FIG. 13 is a graph showing simulation results of the resilience performance of the resilient members according to Verification Examples 2 to 6. FIG. 14 is a table showing characteristics of the resilient members according to Verification Examples 2 to 6. The normalized AER of each of the resilient members according to Verification Examples 2 to 6 is calculated assuming that, in consideration of the fact that each of these resilient members is applied to a shoe sole, as shown in the table in FIG. 14, the pressurization is stopped at the time when the maximum pressure (i.e., σmax) reaches 0.55 MPa, and then, the applied load is removed.

As shown in FIGS. 13 and 14, the stress-strain curves of the resilient members according to Verification Examples 2 to 6 conformed to the stress-strain curve of the resilient member 1A (see FIG. 4) described above. In other words, in the case of the resilient members according to Verification Examples 2 to 6, the loading process included a region where the stress hardly changed even when the strain increased, like a region included in the stress-strain curve of the resilient member 1A, and accordingly, the unloading process also included a region where the stress hardly changed even when the strain decreased.

However, in the case of the resilient member according to Verification Example 2 in which the elastic modulus of base material was relatively small, the strain e at the buckling start point was 19%, whereas the stress σ at the buckling start point was 0.016 MPa. Thus, the buckling start point was out of the above-mentioned required stress range, and accordingly, the normalized AER reached 0.035 J/cm$^3$. Consequently, it was confirmed that sufficient resilient force could not be achieved when the resilient member according to Verification Example 2 was provided in a shoe sole.

Further, in the case of the resilient member according to Verification Example 6 in which the elastic modulus of base material was relatively large, the strain a at the buckling start point was 19%, whereas the stress σ at the buckling start point was 0.820 MPa. Thus, the buckling start point was out of the above-mentioned required stress range, and accordingly, the normalized AER reached 0.027 J/cm$^3$. Consequently, it was confirmed that sufficient resilient force could not be achieved when the resilient member according to Verification Example 6 was provided in a shoe sole.

On the other hand, in the case of the resilient members according to Verification Examples 3 to 5 in which each elastic modulus of base material was within a range between the elastic modulus of the base material of the resilient member according to Verification Example 2 and the elastic modulus of the base material of the resilient member according to Verification Example 6, each of the strains e at the buckling start point was 19% and the respective stresses a at the buckling start point were 0.066 MPa, 0.197 MPa, and 0.492 MPa. Thus, the buckling start points were within both the required strain range and the required stress range, and accordingly, the respective normalized AER reached 0.068 J/cm, 0.083 J/cm$^3$, and 0.155 J/cm$^3$. Consequently, it was confirmed that high resilient force could be achieved when each of the resilient members according to Verification Examples 3 to 5 was applied to a shoe sole.

<Summary of Verification Tests 1 to 4>

Based on the results of Verification Tests 1 to 4 as described above, it is understood that resilient force higher than that in the conventional art can be achieved by a resilient member: configured to have a three-dimensional shape formed by a wall having an outer shape defined by a pair of parallel flat surfaces such that the resilient member may buckle when it receives compression force; and also configured to start buckling within the required strain range and the required stress range when a load is applied to the resilient member in a gradually increasing manner.

In order to facilitate understanding, in the graph shown in FIG. 13, the required strain range and the required stress range mentioned above are shown in dark color. Thus, when the resilient member is designed to start buckling within these dark-colored ranges, high resilient force can be achieved. Accordingly, by applying this resilient member to a shoe sole, a shoe sole and a shoe capable of achieving high propulsive force during running can be obtained.

In this case, the resilient member 1A described above has the unit structure body U configured by adding a thickness to each of divided structure units obtained by dividing a structure unit having the Kelvin structure into two in the height direction. In place of the structure unit having the Kelvin structure, a structure unit having another surface structure may be used.

For example, similarly to the resilient member 1A described above, in the case of a resilient member having a three-dimensional shape formed by a wall having an outer shape defined by a pair of parallel flat surfaces, other structure units such as an octet structure, a cubic structure, and a cubic-octet structure can be used in addition to the Kelvin structure.

Each of the structure units having the surface structures as described above is a structure unit formed of a plurality of flat surfaces disposed to intersect with each other so as to be hollow inside. This structure unit is divided into two in one of the orthogonal three-axis directions, and a thickness is added to each of the divided structure units to thereby form a resilient member. Consequently, the resilient member capable of achieving high resilient force can be obtained.

<Shoe Sole and Shoe According to Embodiment and Shoe Soles and Shoes According to First to Seventh Modifications>

(Embodiment)

Figure 15:
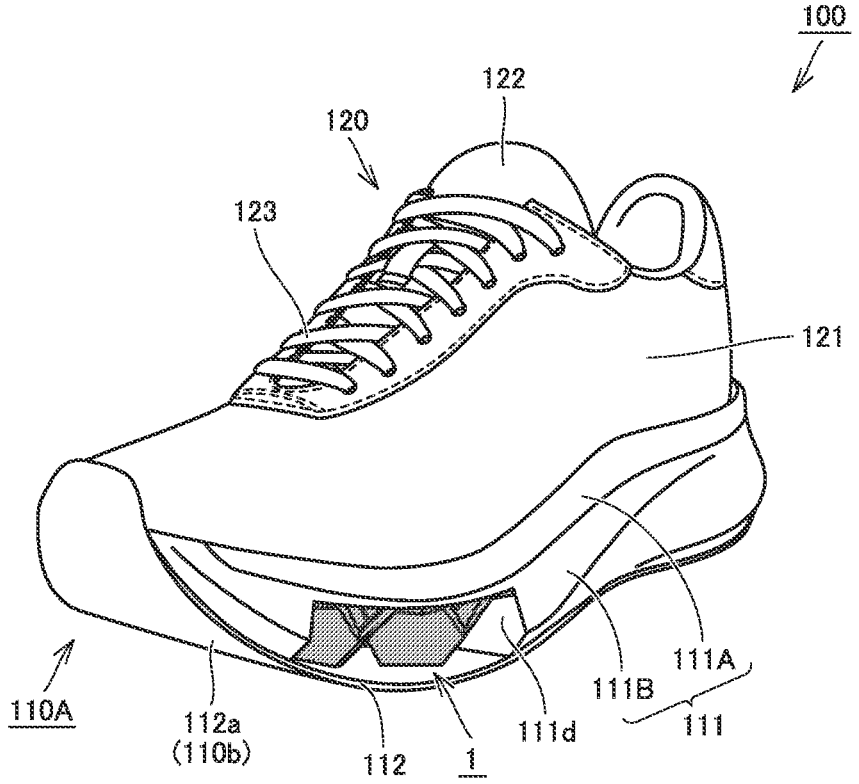
FIG. 15 is a perspective view of a shoe sole and a shoe according to an embodiment.
Figure 16:
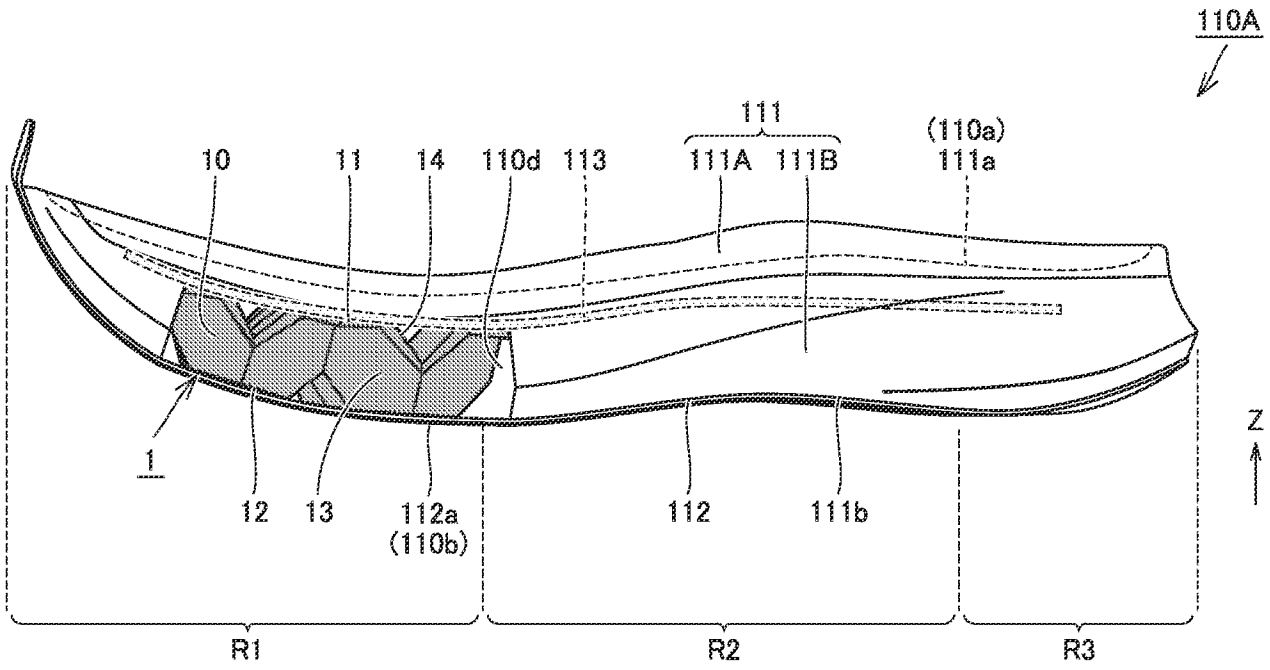
FIG. 16 is a side view of the shoe sole shown in FIG. 15 when viewed from a lateral foot side.
Figure 17:
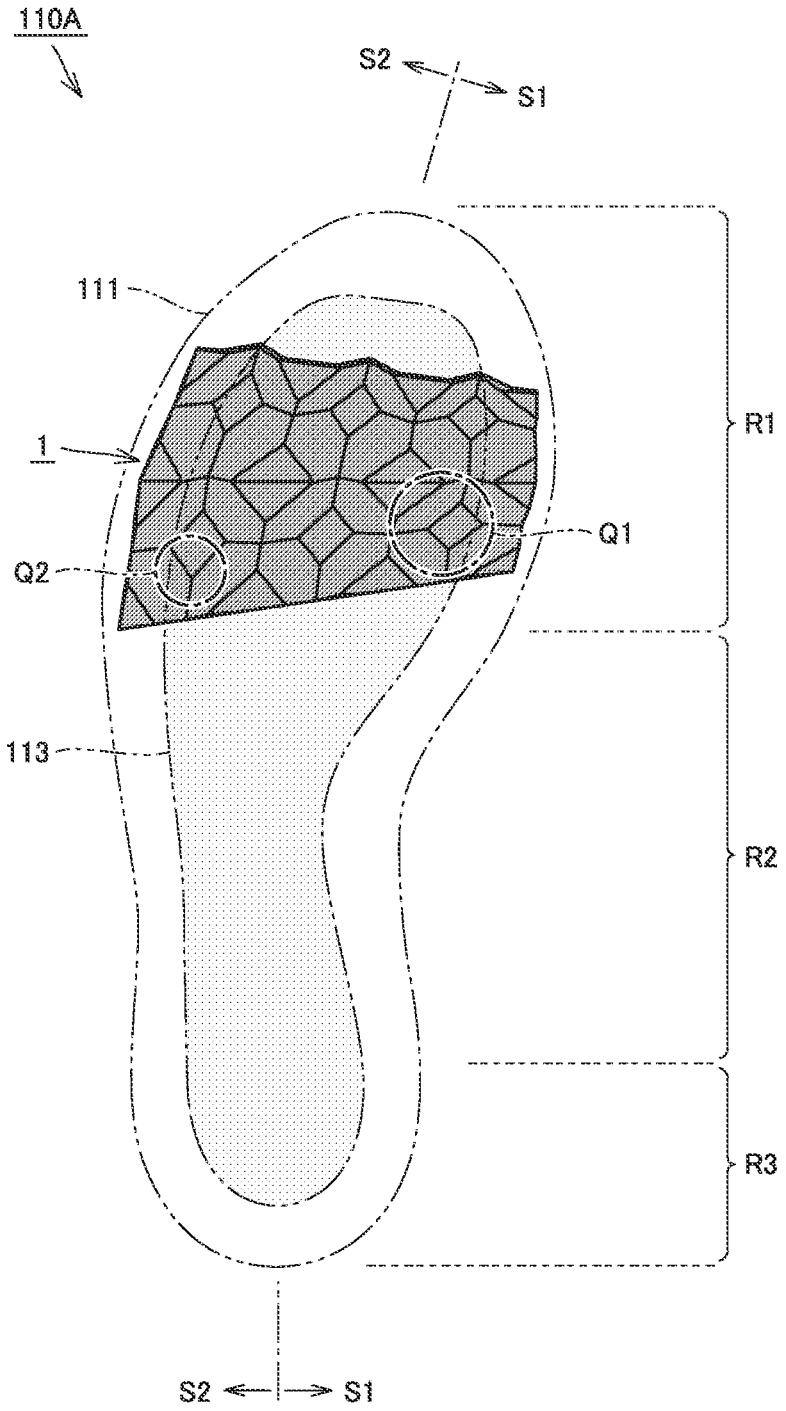
FIG. 17 is a schematic plan view of the shoe sole shown in FIG. 15.
Figure 18:
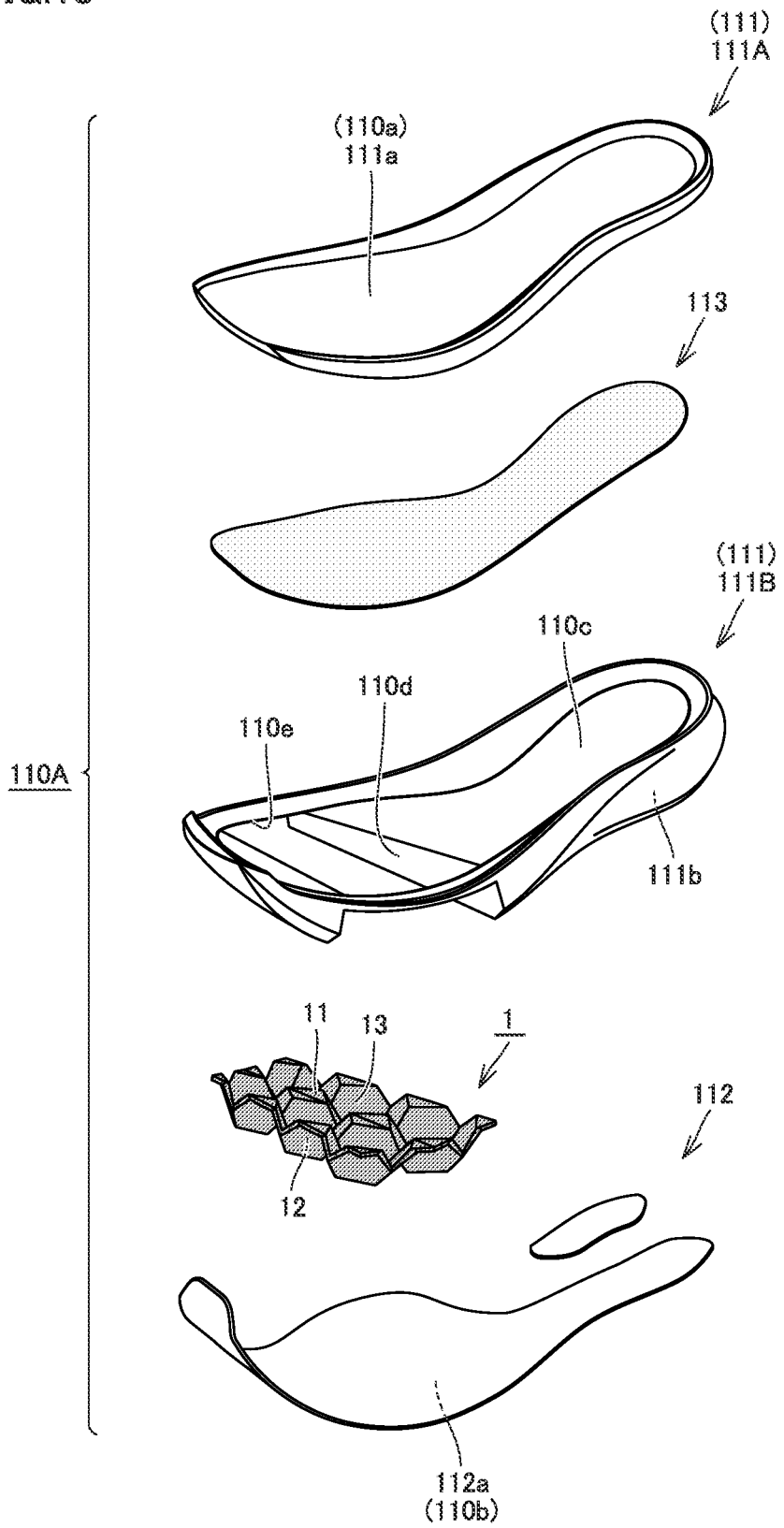
FIG. 18 is an exploded perspective view of the shoe sole shown in FIG. 15.

FIG. 15 is a perspective view of a shoe sole and a shoe according to an embodiment. FIG. 16 is a side view of the shoe sole shown in FIG. 15 when viewed from the lateral foot side. FIG. 17 is a schematic plan view of the shoe sole shown in FIG. 15. FIG. 18 is an exploded perspective view of the shoe sole. Referring to FIGS. 15 to 18, the following describes a shoe sole 110A according to the present embodiment and a shoe 100 including the shoe sole 110A.

As shown in FIG. 15, the shoe 100 includes the shoe sole 110A and an upper 120. The shoe sole 110A is a member covering a sole of a foot and having a substantially flat shape. The upper 120 has a shape at least covering the entire portion of the top of the foot inserted into a shoe and is located above the shoe sole 110A.

The upper 120 includes an upper body 121, a shoe tongue 122, and a shoelace 123. Each of the shoe tongue 122 and the shoelace 123 is fixed or attached to the upper body 121.

The upper portion of the upper body 121 is provided with an upper opening through which the upper portion of an ankle and a part of the top of the foot are exposed. Further, the lower portion of the upper body 121 is provided with, as one example, a lower opening covered by the shoe sole 110A and, as another example, a bottom portion formed by stitching the lower end of the upper body 121 with French seam.

The shoe tongue 122 is fixed to the upper body 121 by sewing, welding, bonding, or a combination thereof so as to cover a portion of the upper opening provided in the upper body 121 through which a part of the top of a foot is exposed. For the upper body 121 and the shoe tongue 122, for example, woven fabric, knitted fabric, nonwoven fabric, synthetic leather, resin, or the like may be used. For shoes particularly required to be air permeable and lightweight, a double raschel warp knitted fabric with a polyester yarn knitted therein may be used.

The shoelace 123 is formed of a member in the form of a string for pulling together, in the foot width direction, portions of a peripheral edge of the upper opening which is provided in the upper body 121 and through which a part of the top of a foot is exposed. The shoelace 123 is passed through a plurality of holes provided along the peripheral edge of the upper opening. When the shoelace 123 is tightened in the state where a foot is inserted into the upper body 121, the upper body 121 can be brought into close contact with the foot.

As shown in FIGS. 15 to 18, the shoe sole 110A includes: a midsole 111 and an outsole 112 as a shoe sole body; a highly rigid plate 113; and a resilient member 1. The midsole 111, the outsole 112, the highly rigid plate 113, and the resilient member 1 are assembled and thereby integrated with each other, so that the shoe sole 110A is entirely formed in an approximately flat shape having a top surface 110*a* and a bottom surface 110*b*.

In this case, the resilient member 1 provided in the shoe sole 110A is similar in basic structure to the resilient member 1A described above and is shown in dark color in the figures in order to facilitate understanding By providing this resilient member 1 in the shoe sole 110A, the shoe sole and the shoe capable of achieving high propulsive force during running can be obtained, which will be described later in detail.

The midsole 111 is located above the outsole 112. Thereby, the top surface 110*a* of the shoe sole 110A is defined by the midsole 111, and the bottom surface 110*b* of the shoe sole 110A is defined by the outsole 112. The highly rigid plate 113 is embedded in the midsole 111 and thereby fixed to the midsole 111. Further, the resilient member 1 is accommodated in a cutout portion 110*d* (described later) provided in the midsole 111 and thereby embedded in the midsole 111.

As shown in FIGS. 16 and 17, the shoe sole 110A is divided into: a forefoot portion R1 that supports a toe portion and a ball portion of the wearer's foot, a midfoot portion R2 that supports an arch portion of the wearer's foot; and a rearfoot portion R3 that supports a heel portion of the wearer's foot, in a front-rear direction (the left-right direction in FIG. 16 and the up-down direction in FIG. 17) that corresponds to a foot length direction of the wearer's foot in a plan view.

In this case, with reference to the front end of the shoe sole 110A, a first boundary position is defined at a position located at 40% of the dimension of the shoe sole 110A from the front end in the front-rear direction, and a second boundary position is defined at a position located at 80% of the dimension of the shoe sole 110A from the front end in the front-rear direction. In this case, the forefoot portion R1 corresponds to a portion included between the front end and the first boundary position in the front-rear direction, the midfoot portion R2 corresponds to a portion included between the first boundary position and the second boundary position in the front-rear direction, and the rearfoot portion R3 corresponds to a portion included between the second boundary position and the rear end of the shoe sole in the front-rear direction.

Further, as shown in FIG. 17, the shoe sole 110A is divided into a portion on the medial foot side (a portion on the S1 side shown in the figure) and a portion on the lateral foot side (a portion on the S2 side shown in the figure) in the left-right direction (the left-right direction in the figure) corresponding to the foot width direction of the wearer's foot in a plan view. In this case, the portion on the medial foot side corresponds to the medial side of the foot in anatomical position (i.e., the side close to the midline) and the portion on the lateral foot side is opposite to the medial side of the foot in anatomical position (i.e., the side away from the midline).

As shown in FIGS. 15 to 18, the midsole 111 extends in the front-rear direction from the forefoot portion R1 through the midfoot portion R2 to the rearfoot portion R3. The midsole 111 has an upper surface 111*a*, a lower surface 111*b*, and a side surface connecting the upper surface 111*a* and the lower surface 111*b*, and forms an upper-side portion of the shoe sole 110A. The upper surface 111*a* of the midsole 111 forms the top surface 110*a* of the shoe sole 110A as described above, and is bonded to the upper 120, for example, with an adhesive or the like.

In this case, as shown particularly in FIG. 18, the midsole 111 is formed of two members including an upper midsole portion 111A and a lower midsole portion 111B. The upper midsole portion 111A defines the top surface 110*a* of the shoe sole 110A described above (i.e., the upper surface 111*a* of the midsole 111), and has a substantially plate-like flat shape. On the other hand, the lower midsole portion 111B is located below the upper midsole portion 111A. The lower midsole portion 111B defines the lower surface 111*b* of the midsole 111 described above, and has a substantially plate-like and relatively thick shape.

An upper surface of the upper midsole portion 111A that defines the top surface 110*a* of the shoe sole 110A has a peripheral edge portion shaped to protrude more than the surrounding area. Thereby, the upper surface of the upper midsole portion 111A is provided with a recessed portion in which the upper 120 is received. The portion of the upper surface of the upper midsole portion 111A that excludes the peripheral edge portion and corresponds to the bottom surface of this recessed portion is shaped to have a smooth curved surface so as to be fitted to the shape of the sole of the wearer's foot.

The upper surface of the lower midsole portion 111B is provided with a recessed portion 110*c* that extends from the forefoot portion R1 to the rearfoot portion R3. The recessed portion 110*c* serves to accommodate the highly rigid plate 113, and is shaped to conform to the outer shape of the highly rigid plate 113.

Further, the cutout portion 110*d* is provided in a part of the lower surface of the lower midsole portion 111B (i.e., the lower surface 111*b* of the midsole 111) that corresponds to the forefoot portion R1. This cutout portion 110*d* serves to accommodate the resilient member 1 as described above and is provided to reach not only the lower surface of the lower midsole portion 111B but also the side surfaces of the lower midsole portion 111B on both the medial foot side and the lateral foot side.

Further, an opening 110*e* is provided in a part of the upper surface of the lower midsole portion 111B that corresponds to the forefoot portion R1. This opening 110*e* allows communication between the recessed portion 110*c* and the cutout portion 110*d*. This allows the highly rigid plate 113 accommodated in the recessed portion 110*c* and the resilient member 1 accommodated in the cutout portion 110*d* to be disposed to directly face each other without having the midsole 111 interposed therebetween, as will be described later.

The midsole 11 is made of a material lower in rigidity than the material forming the resilient member 1. The midsole 111 is preferably excellent in shock absorbing performance while having proper strength. For this purpose, the midsole 111 can be formed of a member, for example, made of resin or rubber, and may be particularly suitably formed of a foam material or a non-foam material such as a polyolefin resin, ethylene-vinyl acetate copolymer (EVA), polyamide-based thermoplastic elastomer (TPA, TPAE), thermoplastic polyurethane (TPU), polyester-based thermoplastic elastomer (TPEE), and the like.

Note that the upper midsole portion 111A and the lower midsole portion 111B are fixed by bonding, for example, with an adhesive or the like, the upper midsole portion 111A and the lower midsole portion 111B that are superposed on each other in the state in which the highly rigid plate 113 is accommodated in the recessed portion 110*c* provided in the lower midsole portion 111B.

As shown in FIGS. 15 to 18, the outsole 112 extends in the front-rear direction from the forefoot portion R1 through the midfoot portion R2 to the rearfoot portion R3. The outsole 112 may be formed of a single member or may be divided into a plurality of members as shown in FIG. 18.

The outsole 112 has a relatively thin sheet-like shape and has an upper surface and a lower surface. The outsole 112 forms a lower-side portion of the shoe sole 110A and has a lower surface defining the bottom surface 110*b* of the shoe sole 110A. The outsole 112 has an upper surface bonded to the lower surface 111*b* of the midsole 111, for example, with an adhesive or the like.

The outsole 112 is preferably excellent in wear resistance and grip performance. From this viewpoint, the outsole 112 may be made of rubber, for example Note that a tread pattern may be provided on a ground contact surface 112*a* corresponding to the lower surface of the outsole 112 for the purpose of enhancing the grip performance.

As shown in FIGS. 16 to 18, the highly rigid plate 113 is formed of a single member and extends in the front-rear direction (i.e., the direction intersecting with the ground contact surface 112*a* that corresponds to the bottom surface 110*b* of the shoe sole 110A) so as to extend from the forefoot portion R1 through the midfoot portion R2 to the rearfoot portion R3. More specifically, the highly rigid plate 113 is disposed in a portion of the forefoot portion R1 excluding the front end portion and a portion of the rearfoot portion R3 excluding the rear end portion in the front-rear direction of the shoe sole 110A while extending between the medial foot-side portion (the portion on the S1 side) and the lateral foot-side portion (the portion on the S2 side) in the left-right direction of the shoe sole 111A. In FIG. 17, the region where the highly rigid plate 113 is disposed is shown in light color in order to facilitate understanding.

The highly rigid plate 113 is entirely formed of a plate-like member, and embedded in the midsole 111 and thereby fixed to the midsole 111 as described above. More specifically, the highly rigid plate 113 is accommodated in the recessed portion 110*c* provided in the upper surface of the lower midsole portion 111B as described above, and thereby, sandwiched between the upper midsole portion 111A and the lower midsole portion 111B, and thus, embedded in the midsole 111.

In this case, examples of the specific method of embedding the highly rigid plate 113 in the midsole 111 may include, for example, a method of inserting the highly rigid plate 113 during cast molding or injection molding of the midsole 111, in addition to the above-described method of inserting the highly rigid plate 113 to be sandwiched between two divided upper and lower parts of the midsole 111 during bonding.

The highly rigid plate 113 is made of a material higher in rigidity than the material of the midsole 111. The material of the highly rigid plate 113 is not particularly limited, and examples suitably applicable as reinforcing fibers may include: fiber-reinforced resin formed using carbon fibers, glass fibers, aramid fibers, Dyneema® fibers, Zylon® fibers, boron fibers, or the like; and non-fiber-reinforced resin made of a polymer resin such as urethane-based thermoplastic elastomer (TPU) or amide-based thermoplastic elastomer (TPA).

As shown in FIGS. 15 to 18, the resilient member 1 is similar in basic structure to the resilient member 1A as described above, and more specifically, the unit structure body U is formed by adding a thickness to each of divided structure units obtained by dividing a structure unit having the Kelvin structure into two in the height direction.

In this case, for providing the resilient member 1 in the shoe sole 110A, the resilient member 1 is configured such that its shape (for example, the outer shape or the like of the unit structure body U in a plan view as shown particularly in FIG. 18) is slightly deformed while maintaining the basic structure of the above-mentioned resilient member 1A. Except for the configurations as described above, the resilient member 1 is the same as the above-mentioned resilient member 1A.

The resilient member 1 is accommodated in the cutout portion 110*d* provided in the lower midsole portion 111B, and is disposed such that its height direction (the Z direction shown in the figure) corresponds to a normal direction to the ground contact surface 112*a* that is the bottom surface 110*b* of the shoe sole 110A.

As described above, since the opening 110*e* is provided above the cutout portion 110*d* of the lower midsole portion 111B, the upper surface of the resilient member 1 accommodated in the cutout portion 110*d* faces the highly rigid plate 113 through the opening 110*e*. Thus, the upper wall portion 11 of the resilient member 1 is bonded to the lower surface of the highly rigid plate 113, for example, with an adhesive or the like, so that the resilient member 1 is fixed to the highly rigid plate 113.

On the other hand, the lower surface of the resilient member 1 faces the outsole 112, and the lower wall portion 12 of the resilient member 1 is bonded to the upper surface of the outsole 112, for example, with an adhesive or the like, so that the resilient member 1 is fixed to the outsole 112.

In other words, the resilient member 1 is disposed such that its upper surface reaches the highly rigid plate 113 and its lower surface reaches the outsole 112, and thereby, the resilient member 1 is sandwiched and held between the highly rigid plate 113 and the outsole 112.

As described above, the cutout portion 110*d* in which the resilient member 1 is accommodated reaches the side surfaces of the midsole 111 on both the medial foot side and the lateral foot side. Accordingly, the resilient member 1 is exposed to the outside, and due to the structure of the resilient member 1, an opened portion 14 (see FIG. 16) to be provided on the side portion of the resilient member 1 is also located to be exposed to the outside.

In this case, as shown particularly in FIG. 17, the resilient member 1 is disposed in a portion of the forefoot portion R1 located closer to the midfoot portion R2 so as to be located in a portion that supports a toe of the wearer's foot. Thereby, the resilient member 1 is located to extend over a portion Q1 that supports a ball of the wearer's foot and a portion Q2 that supports a hypothenar of the wearer's foot. In the configuration as described above, the resilient member 1 is disposed in a portion of the forefoot portion R1 located closer to the midfoot portion R2 and receiving the largest load during running, so that high resilient force can be effectively achieved.

In this case, due to the structure of the resilient member 1, the outer shape of the resilient member 1 is basically the same even when the resilient member 1 is turned upside down. However, in the state in which the resilient member 1 is turned upside down, the protrusions and the recesses appearing in the surface of the resilient member 1 are displaced in position. This requires the top side and the bottom side of the resilient member 1 to be set in a manufacturing process.

At this time, in order to achieve higher resilience performance, it is preferable that the upper wall portion 11 of the resilient member 1 is not located at positions corresponding to the portion Q1 that supports a ball of the wearer's foot and the portion Q2 that supports a hypothenar of the wearer's foot. However, high resilience performance still can be achieved even when the upper wall portion 11 of the resilient member 1 is located at positions corresponding to the portion Q1 that supports a ball of the wearer's foot and the portion Q2 that supports a hypothenar of the wearer's foot.

According to the shoe sole 110A of the present embodiment and the shoe 100 including the shoe sole 110A as described above, based on the high resilience performance of the resilient member 1, the resilient force of the resilient member 1 is applied to the wearer's foot when the wearer's foot pushes off from the ground, and accordingly, high propulsive force can be achieved. Therefore, according to the configuration as described above, the shoe sole 110A excellent in running performance and the shoe 100 including the shoe sole 110A can be obtained.

(First to Third Modifications)

Figure 19:
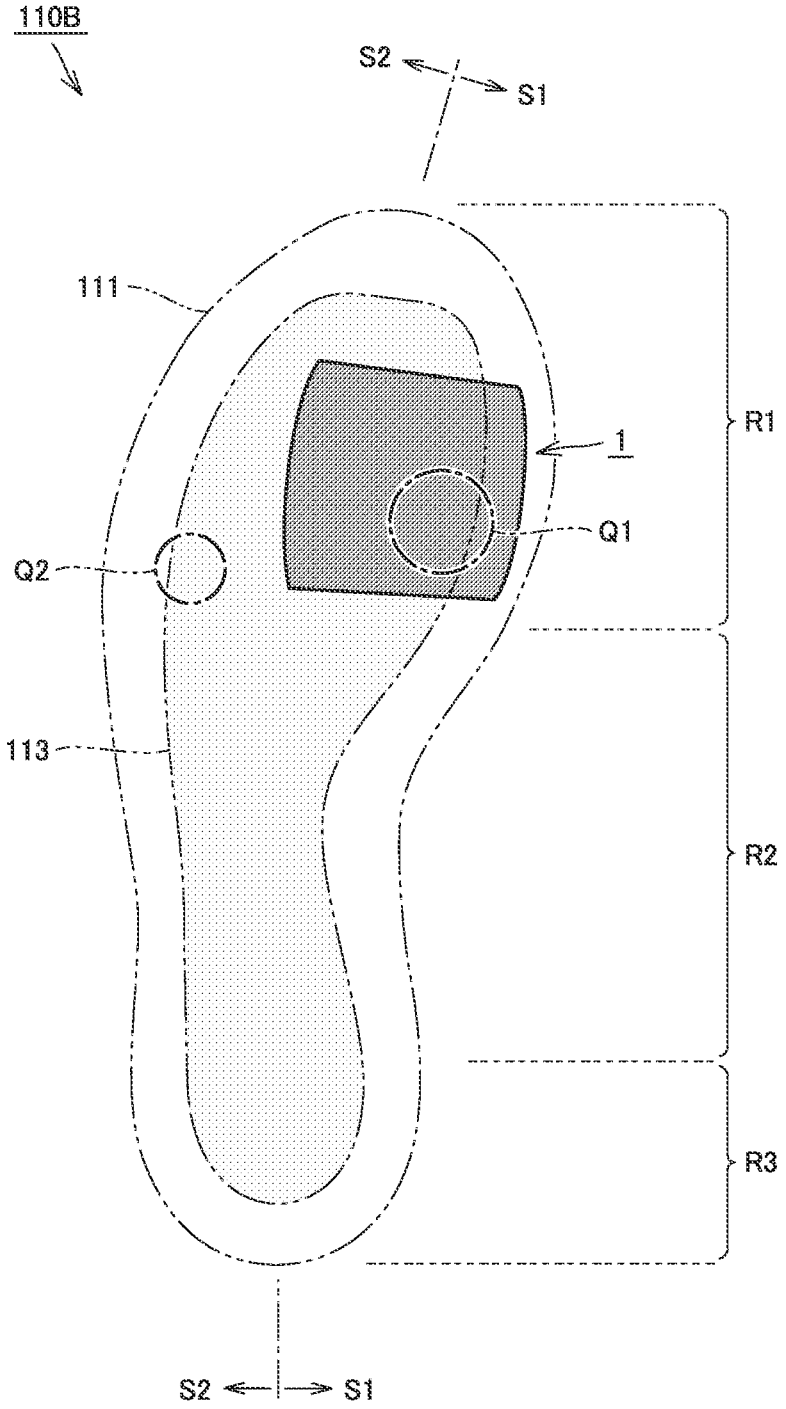
FIG. 19 is a schematic plan view of a shoe sole according to a first modification.
Figure 20:
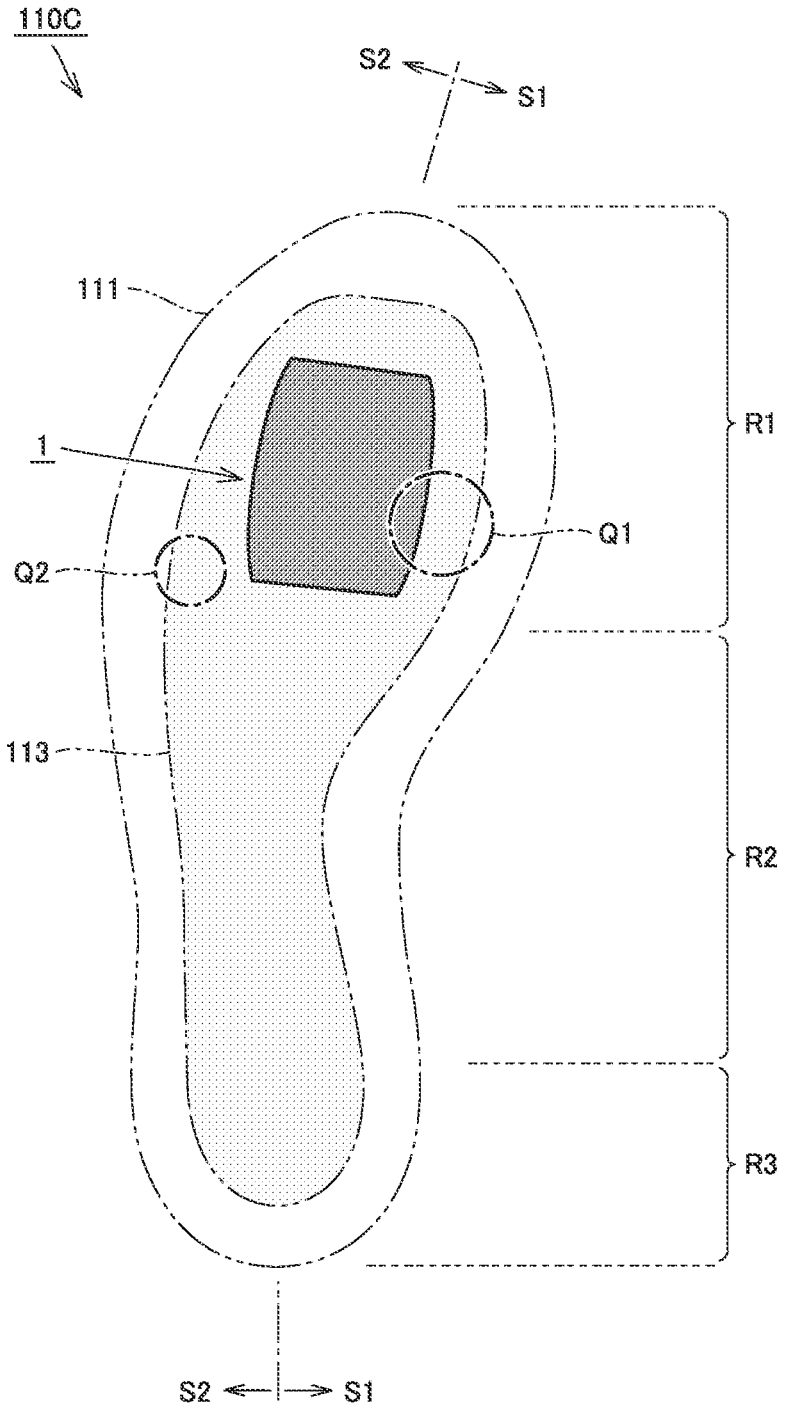
FIG. 20 is a schematic plan view of a shoe sole according to a second modification.
Figure 21:
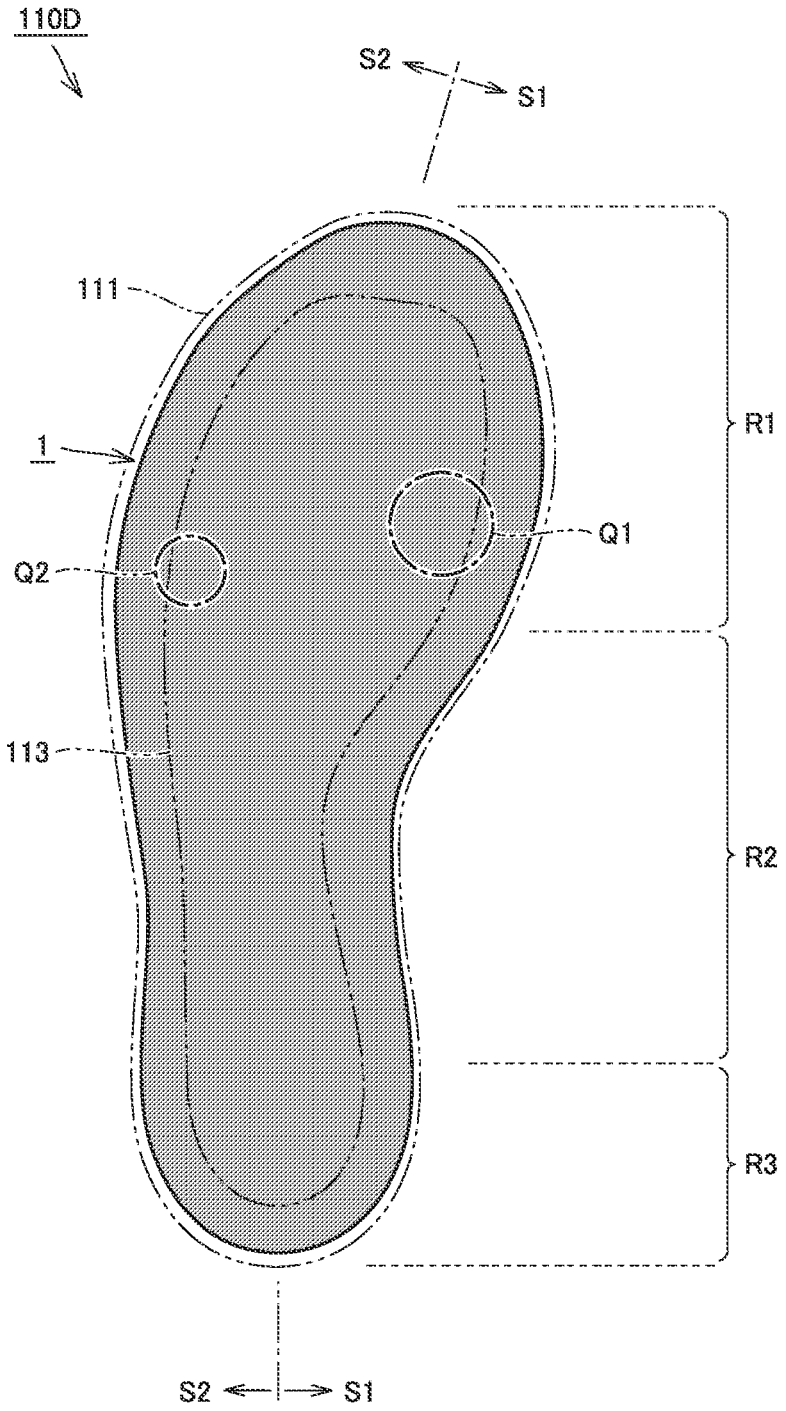
FIG. 21 is a schematic plan view of a shoe sole according to a third modification.

FIGS. 19 to 21 are schematic plan views of shoe soles according to the respective first to third modifications. Referring to FIGS. 19 to 21, the following describes shoe soles 110B to 110D according to the first to third modifications based on the above-described embodiment. In place of the shoe sole 110A according to the above-described embodiment, each of the shoe soles 110B to 110D according to the first to third modifications is included in the shoe 100.

As shown in FIGS. 19 to 21, the shoe soles 110B to 110D according to the first to third modifications are different from the shoe sole 110A according to the above-described embodiment only in arrangement position of the resilient member 1 in a plan view. In FIGS. 19 to 21, without representing the specific shape of the resilient member 1 for convenience of illustration, the region where the resilient member 1 is disposed is shown in dark color while the region where the highly rigid plate is disposed is shown in light color.

As shown in FIG. 19, in the shoe sole 110B according to the first modification, the resilient member 1 is disposed only in a portion of the forefoot portion R1 located closer to the midfoot portion R2 and also located on the medial foot side (i.e., a portion on the S1 side). In the configuration as described above, the resilient member 1 is disposed at a position corresponding to the portion Q1 that supports a ball of the wearer's foot, but not disposed at a position corresponding to the portion Q2 that supports a hypothenar of the wearer's foot.

However, even in the configuration as described above, a certain amount of resilient force is achieved, and thereby, the shoe sole 110B capable of achieving high propulsive force can be obtained. Although not shown in the figure, in contrast, the resilient member 1 may be disposed only in a portion of the forefoot portion R1 located closer to the midfoot portion R2 and also located on the lateral foot side (i.e., a portion on the S2 side).

As shown in FIG. 20, in the shoe sole 110C according to the second modification, the resilient member 1 is disposed only in a portion of the forefoot portion R1 located closer to the midfoot portion R2 and also in a central area in the foot width direction. Even in the configuration as described above, a certain amount of resilient force is achieved, and thereby, the shoe sole 110C capable of achieving high propulsive force can be obtained.

As shown in FIG. 21, in the shoe sole 110D according to the third modification, the resilient member 1 is provided to substantially entirely extend over the forefoot portion R1, the midfoot portion R2, and the rearfoot portion R3. In the configuration as described above, high resilient force is achieved substantially entirely over the forefoot portion R1, the midfoot portion R2, and the rearfoot portion R3, and thereby, the shoe sole 110D capable of achieving higher propulsive force can be obtained.

(Fourth to Seventh Modifications)

FIGS. 22 to 25 are schematic side views of shoe soles according to the respective fourth to seventh modifications when viewed from the lateral foot side. Referring to FIGS. 22 to 25, the following describes shoe soles 110E to 110H according to the respective fourth to seventh modifications based on the above-described embodiment. In place of the shoe sole 110A according to the embodiment described above, each of the shoe soles 110E to 110H according to the fourth to seventh modifications is included in the shoe 100.

As shown in FIGS. 22 to 25, each of the shoe soles 110E to 110H according to the fourth to seventh modifications is different from the shoe sole 110A according to the above-described embodiment in arrangement position of the resilient member 1 in a side view, or additionally, in arrangement position, number, presence or absence and the like of the highly rigid plate 113. In this case, in FIGS. 22 to 25, without representing the specific shape of the resilient member 1 for convenience of illustration, the region where the resilient member 1 is disposed is shown in dark color while the region where the highly rigid plate is disposed is shown in light color.

Figure 22:
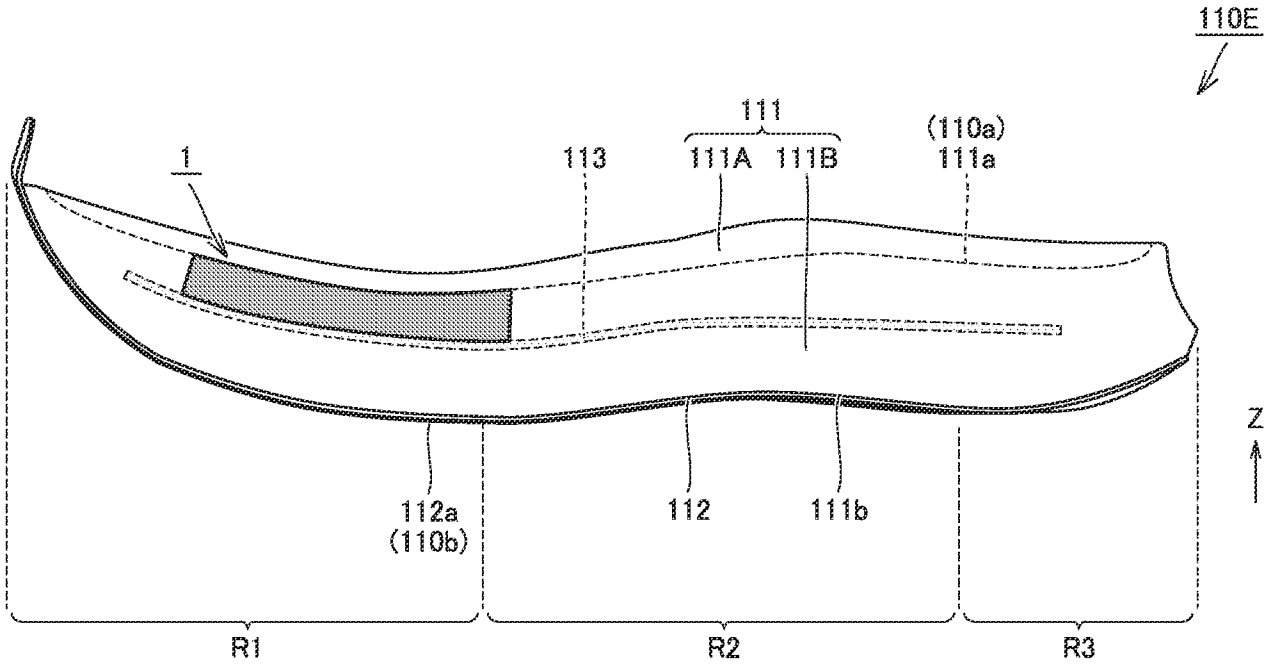
FIG. 22 is a schematic side view of a shoe sole according to a fourth modification when viewed from the lateral foot side.

As shown in FIG. 22, in the shoe sole 110E according to the fourth modification, the highly rigid plate 113 is disposed at the same position as that of the shoe sole 110A according to the above-described embodiment, while the resilient member 1 is not disposed between the highly rigid plate 113 and the outsole 112 but disposed above the highly rigid plate 113.

Specifically, the resilient member 1 is embedded in the midsole 111 such that the upper surface (i.e., the upper wall portion 11) of the resilient member 1 defines the top surface 110*a* of the shoe sole 110E while the lower surface (i.e., the lower wall portion 12) of the resilient member 1 reaches the highly rigid plate 113. Thereby, the lower wall portion 12 of the resilient member 1 is bonded to the upper surface of the highly rigid plate 113, for example, with an adhesive or the like, so that the resilient member 1 is fixed to the highly rigid plate 113.

Even in the configuration as described above, a certain amount of resilient force is achieved, and thereby, the shoe sole 110E capable of achieving high propulsive force can be obtained. In the configuration as described above, an insole or a sockliner that is higher in rigidity than the resilient member 1 is preferably disposed on the upper surface of the shoe sole 110E. According to the configuration as described above, the resilient member 1 is sandwiched between the insole or the sockliner and the highly rigid plate 113, so that high resilient force can be achieved.

Figure 23:
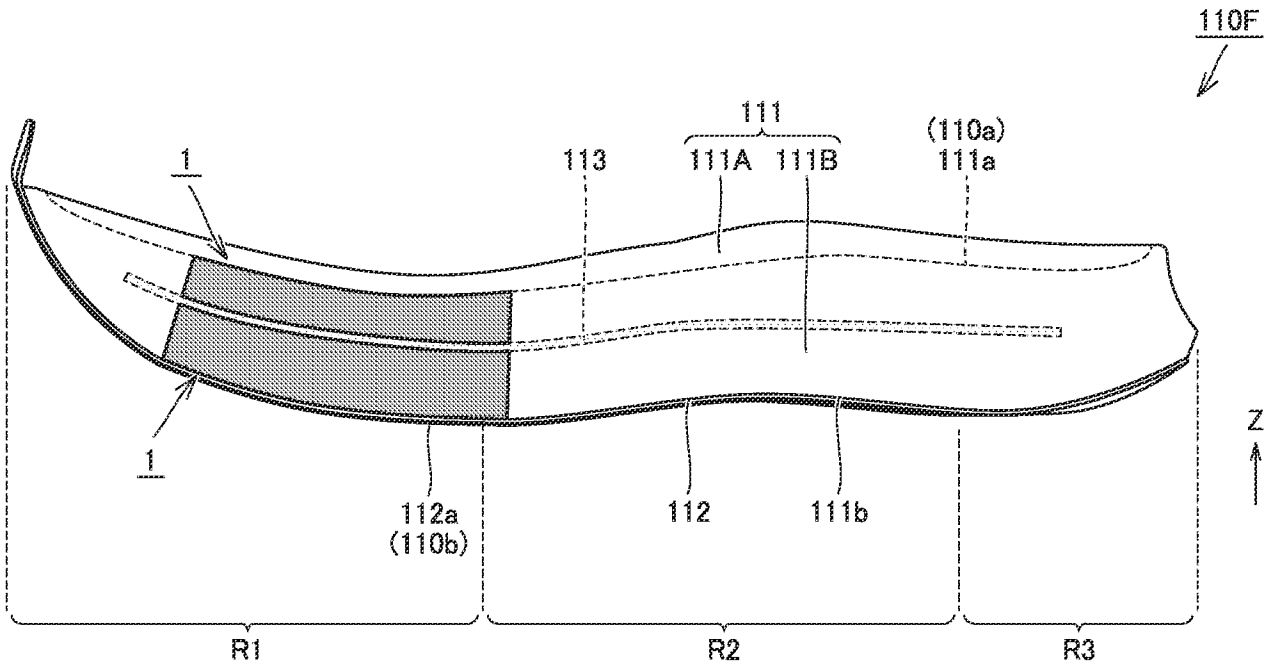
FIG. 23 is a schematic side view of a shoe sole according to a fifth modification when viewed from the lateral foot side.

As shown in FIG. 23, in the shoe sole 110F according to the fifth modification, the highly rigid plate 113 is disposed at the same position as that of the shoe sole 110A according to the above-described embodiment, while the resilient member 1 is disposed not only between the highly rigid plate 113 and the outsole 112 but also above the highly rigid plate 113. The specific configuration of the pair of resilient members 1 is the same as those of the shoe sole 110A according to the above-described embodiment and the shoe sole 110E according to the fourth modification.

In the configuration as described above, higher resilient force is achieved, so that the shoe sole 111F capable of achieving still higher propulsive force can be obtained.

Figure 24:
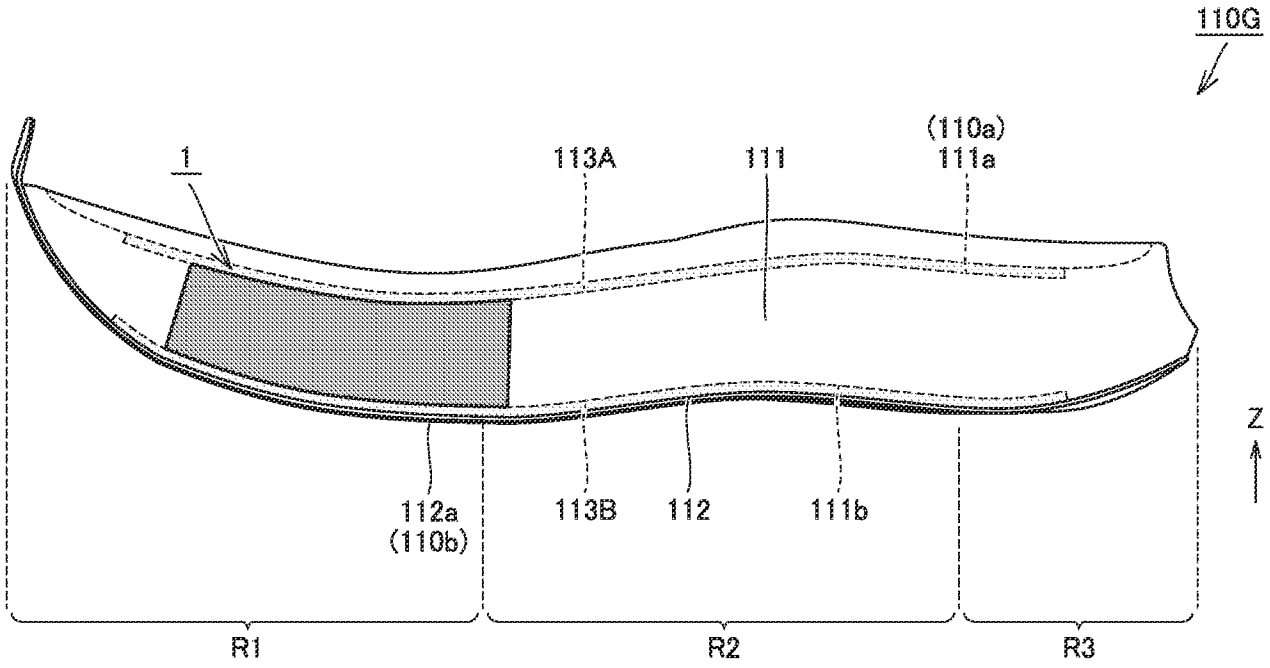
FIG. 24 is a schematic side view of a shoe sole according to a sixth modification when viewed from the lateral foot side.

As shown in FIG. 24, the shoe sole 110G according to the sixth modification is different from the shoe sole 110A according to the above-described embodiment in configuration of the midsole 11, in arrangement position and number of the highly rigid plate(s) 113, and also in arrangement position of the resilient member 1.

Specifically, in the shoe sole 110G according to the sixth modification, the midsole 111 is formed of a single member, an upper highly rigid plate 113A is disposed so as to cover an upper surface 111*a* of the midsole 11, and a lower highly rigid plate 113B is disposed so as to cover a lower surface 111*b* of the midsole 111. Thus, the upper surface of the upper highly rigid plate 113A defines a top surface 110*a* of the shoe sole 110G.

The resilient member 1 is embedded in the midsole 111 such that the upper surface (i.e., the upper wall portion 11) of the resilient member 1 reaches the upper highly rigid plate 113A while the lower surface (i.e., the lower wall portion 12) of the resilient member 1 reaches the lower highly rigid plate 113B. Accordingly, the upper wall portion 11 of the resilient member 1 is bonded to the lower surface of the upper highly rigid plate 113A, for example, with an adhesive or the like, and the lower wall portion 12 of the resilient member 1 is bonded to the upper surface of the lower highly rigid plate 113B, for example, with an adhesive or the like, so that the resilient member 1 is fixed to this pair of the upper highly rigid plate 113A and the lower highly rigid plate 113B.

In the configuration as described above, higher resilient force is achieved, so that the shoe sole 110G capable of achieving still higher propulsive force can be obtained.

Figure 25:
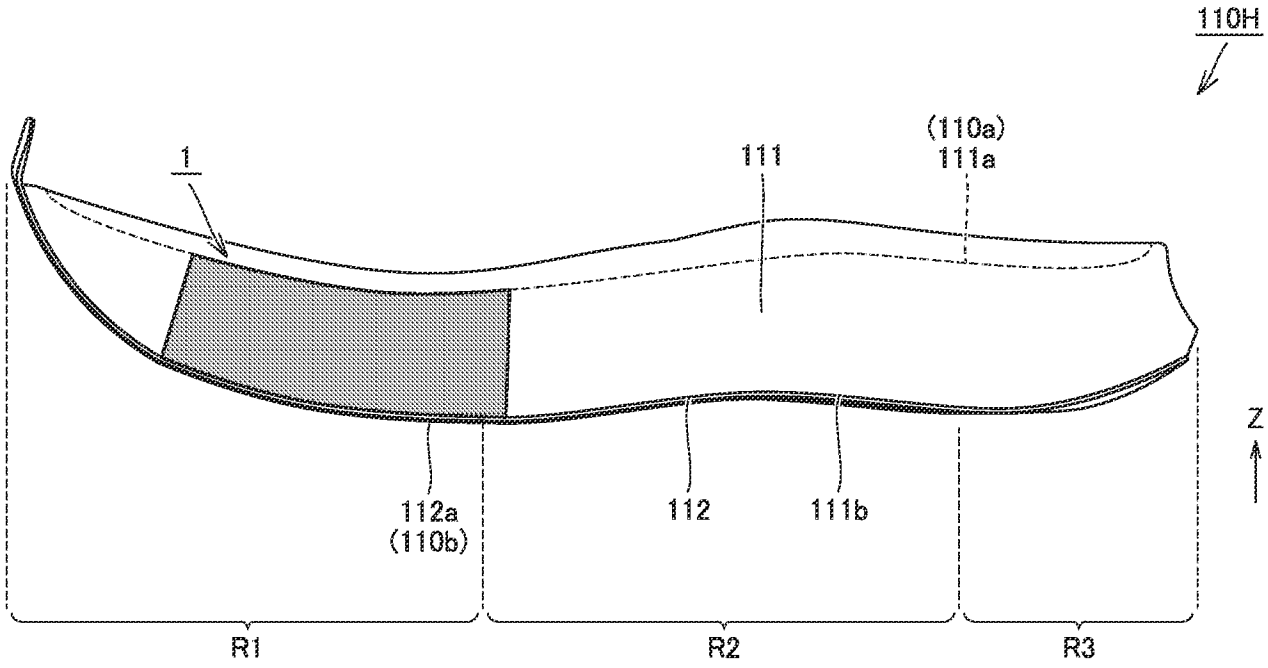
FIG. 25 is a schematic side view of a shoe sole according to a seventh modification when viewed from the lateral foot side.

As shown in FIG. 25, the shoe sole 110H according to the seventh modification is different from the shoe sole 110A according to the above-described embodiment in configuration of the midsole 111, in arrangement position of the resilient member 1, and in configuration in which the highly rigid plate 113 (see FIG. 16 and the like) is not provided.

Specifically, in the shoe sole 110H according to the seventh modification, the midsole 111 is formed of a single member, and the resilient member 1 is disposed so as to be exposed on both the upper surface 111*a* and the lower surface 111*b* of the midsole 111. Thereby, the resilient member 1 is embedded in the midsole 111 such that the upper surface (i.e., the upper wall portion 11) of the resilient member 1 defines the top surface 110*a* of the shoe sole 110H and the lower surface (i.e., the lower wall portion 12) of the resilient member 1 reaches the outsole 112. Accordingly, the lower wall portion 12 of the resilient member 1 is bonded to the upper surface of the outsole 112, for example, with an adhesive or the like, so that the resilient member 1 is fixed to the outsole 112.

Also in the configuration as described above, a certain amount of resilient force is achieved, and thereby, the shoe sole 110H capable of achieving high propulsive force can be obtained. In the configuration as described above, an insole or a sockliner that is higher in rigidity than the resilient member 1 is preferably disposed on the upper surface of the shoe sole 110H. According to the configuration as described above, the resilient member 1 is sandwiched between the insole or the sockliner and the outsole 112, so that high resilient force can be achieved.

<Resilient Member Similar in Structure to Resilient Member Included in Shoe Sole According to Embodiment>

Figure 26A:
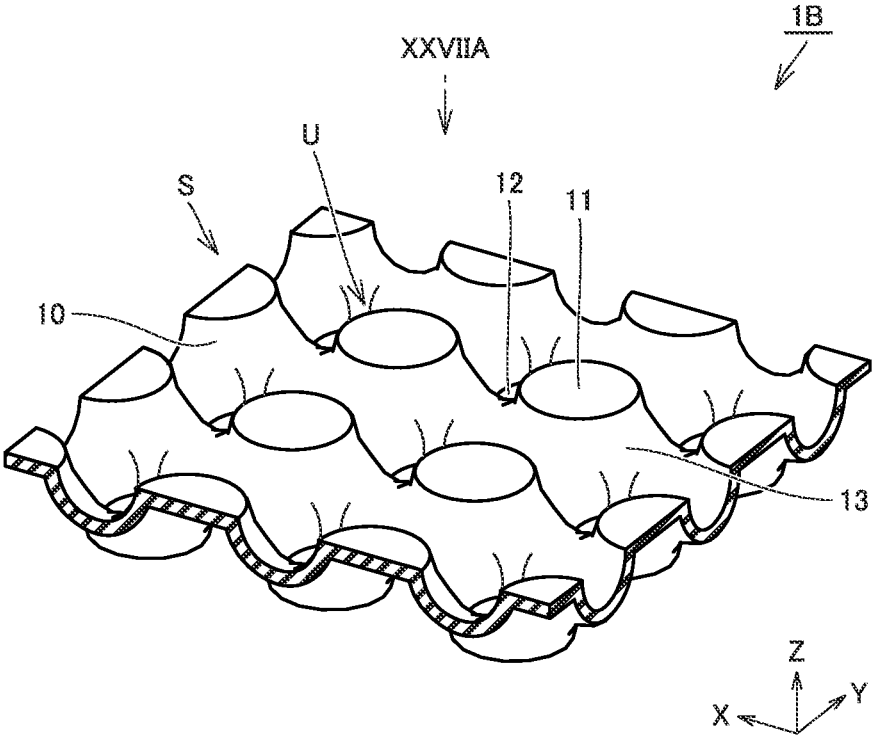
FIG. 26A is a perspective view of a resilient member similar in structure to the resilient member included in the shoe sole according to the embodiment.
Figure 26B:
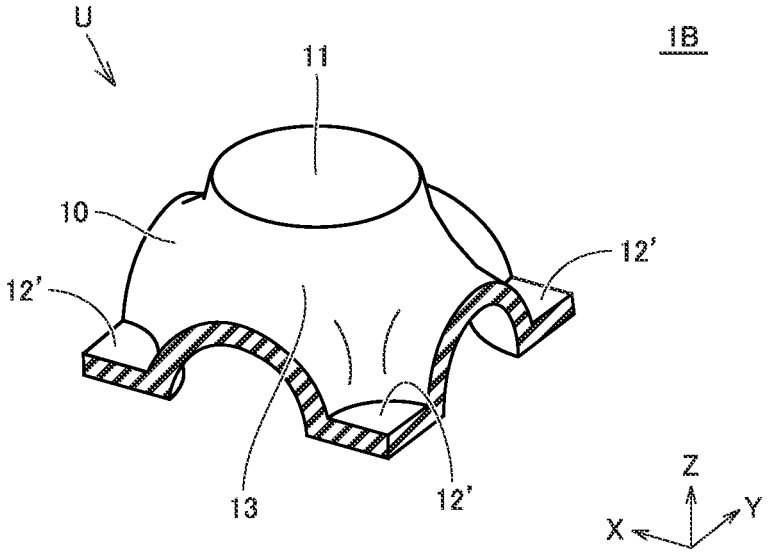
FIG. 26B is a perspective view of a unit structure body forming the resilient member shown in FIG. 26A.
Figure 27A:
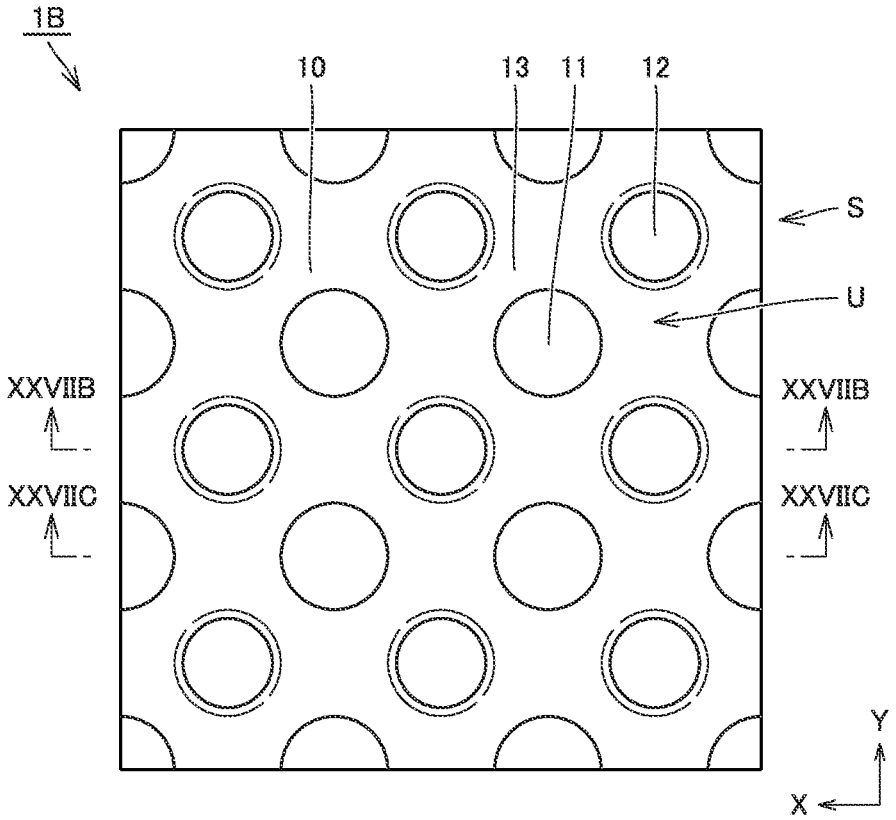
FIG. 27A is a plan view of the resilient member shown in FIG. 26A.
Figure 27B:
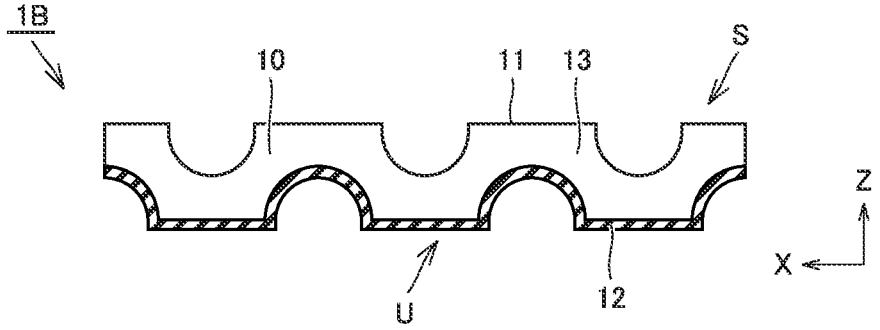
FIGS. 27B and 27C each are a cross-sectional view of the resilient member shown in FIG. 26A.
Figure 27C:
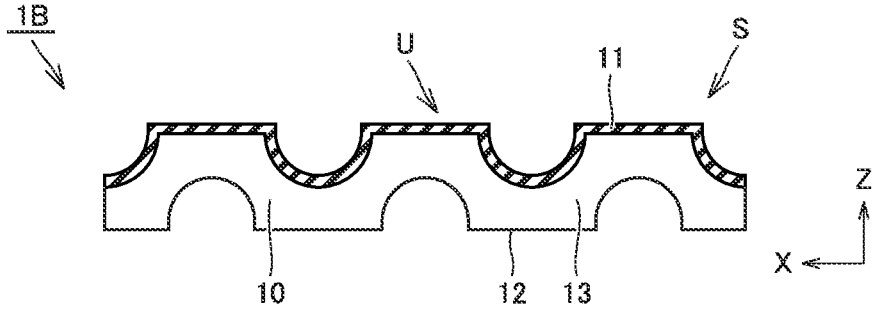

FIG. 26A is a perspective view of a resilient member similar in structure to the resilient member included in the shoe sole according to the embodiment. FIG. 26B is a perspective view of a unit structure body forming the resilient member. FIG. 27A is a plan view of the resilient member shown in FIG. 26A that is viewed in the direction indicated by an arrow XXVIIA shown in FIG. 26A. FIGS. 27B and 27C are cross-sectional views taken along lines XXVIIB-XXVIIB and XXVIIC-XXVIC, respectively, shown in FIG. 27A. Referring to FIGS. 26A, 26B, and 27A to 27C, the following describes a configuration of a resilient member 1B similar in structure to the resilient member included in the shoe sole according to the above-described embodiment.

As shown in FIGS. 26A and 27A to 27C, the resilient member 1B includes a three-dimensional structure S having a plurality of unit structure bodies U. Each of the plurality of unit structure bodies U has a three-dimensional shape formed by a wall 10 having an outer shape defined by a pair of parallel curved surfaces (see FIG. 26B). Thereby, the three-dimensional structure S also has a three-dimensional shape formed by the wall 10 having an outer shape defined by a pair of parallel curved surfaces.

The unit structure body U has a structure obtained by adding a thickness to a base structure unit having a geometrical surface structure More specifically, the unit structure body U is formed by adding a thickness to each of divided structure units obtained by dividing a structure unit having a mathematically defined triply periodic minimal surface into two in one of its orthogonal three-axis directions. Note that a minimal surface is defined as a curved surface that is minimal in area among the curved surfaces having a given closed curve as a boundary.

In this case, in the unit structure body U shown in FIG. 26B, the above-described surface structure is a Schwartz P structure, and the unit structure body U is formed by adding a thickness to each of divided structure units obtained by dividing a structure unit having the Schwartz P structure into two in the height direction (the Z-axis direction shown in the figure) among the orthogonal three-axis directions.

More specifically, the unit structure body U includes one upper wall portion 11, four divided lower wall portions 12', and one upright wall portion 13 connecting the upper wall portion 11 and the lower wall portions 12'. The upright wall portion 13 extends to intersect with the upper wall portion 11 and the lower wall portions 12', and is entirely formed in a substantially annular shape. Note that each of the upper wall portion 11 and the lower wall portions 12' has a flat plate shape, and the upright wall portion 13 has a curved plate shape.

Each of the four divided lower wall portions 12' included in one unit structure body U is arranged continuously to, and thereby integrated with, one of the lower wall portions 12' included in another unit structure body U adjacent to the one unit structure body U. Thus, in the three-dimensional structure S, each of the lower wall portions 12' included in each of four unit structure bodies U adjacent to each other is arranged continuously to an adjacent lower wall portion 12' included in a corresponding one of these four unit structure bodies U, to thereby form one lower wall portion 12 substantially similar in shape to the above-mentioned one upper wall portion 11 (see FIG. 26A and the like).

The resilient member 1B according to the present embodiment is intended to exhibit a resilience function in the above-mentioned height direction. Thus, as shown in FIGS. 26A and 27A to 27C, the plurality of unit structure bodies U are repeatedly arranged in a regular and continuous manner in each of a width direction (an X direction shown in the figure) and a depth direction (a Y direction shown in the figure) among the orthogonal three-axis directions. Thereby, the three-dimensional structure S has a structure in which upward protruding portions and downward protruding portions are alternately arranged in a plan view. FIGS. 26A and 27A to 27C each show only three unit structure bodies U arranged adjacent to each other in the width direction and the depth direction.

In this case, in the illustrative description of the present embodiment, the resilient member 1B is formed of a large number of unit structure bodies U arranged in the width direction and the depth direction, but the number of unit structure bodies U repeatedly arranged in the width direction and the depth direction is not particularly limited. In other words, the resilient member may be formed by arranging two or more unit structure bodies U in only one of the width direction and the depth direction, or may be formed of only a single unit structure body U.

The method of manufacturing the resilient member 1A and the material of the resilient member 1A as described above are applicable as the method of manufacturing the resilient member 1B and the material of the resilient member 1B.

Similarly to the above-described resilient member 1A, the resilient member 1B configured in this way also undergoes compressive deformation when a load is gradually applied to the resilient member 1B by pressurization in the height direction (the Z-axis direction shown in the figure). At this time, due to the structure of the resilient member 1B, the upright wall portion 13 deforms, and then, a load above a certain level is applied to thereby cause buckling in the upright wall portion 13.

On the other hand, when the pressure application is stopped, the load applied to the resilient member 1B in the height direction decreases and disappears. Thereby, the compressive deformation occurring in the resilient member 1B is removed and the resilient member 1B returns to its original shape. At this time, buckling occurring in the resilient member 1B also disappears. When such compressive deformation is removed, the elastic restoring force of the resilient member 1B causes resilient force that consequently determines the resilience performance of the resilient member 1B.

<Verification Test 5>

In Verification Test 5, a simulation model corresponding to the resilient member 1B described above was prepared as Verification Example 7 and subjected to a structural analysis using a finite element method (FEM), to thereby calculate a stress-strain curve of the resilient member according to Verification Example 7 formed of the simulation model.

Figures 28, 29:
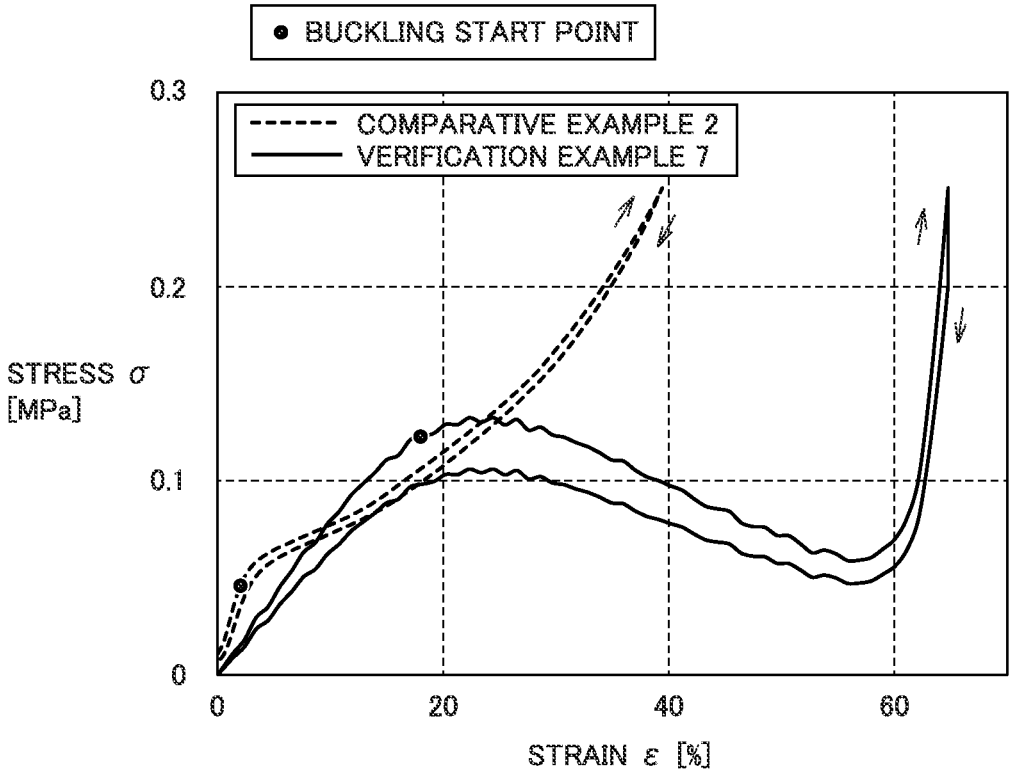
FIG. 28 is a graph showing simulation results of resilience performance of a resilient member according to Verification Example 7.
FIG. 29 is a table showing characteristics of the resilient member according to Verification Example 7

FIG. 28 is a graph showing simulation results of resilience performance of the resilient member according to Verification Example 7. FIG. 29 is a table showing characteristics of the resilient member according to Verification Example 7. In this case, for comparison, FIGS. 28 and 29 each additionally show the results of Comparative Example 2 by which it was confirmed that the highest resilient force was achieved in the above-described Verification Test 1.

As shown in FIG. 28, the stress-strain curve of the resilient member according to Verification Example 7 conformed to the stress-strain curve of the resilient member 1A (see FIG. 4) described above. In other words, in the case of the resilient member according to Verification Example 7, the loading process included a region where the stress hardly changed even when the strain increased, like a region included in the stress-strain curve of the above-described resilient member 1A. Accordingly, the unloading process also included a region where the stress hardly changed even when the strain decreased.

In this case, as shown in FIG. 29, the normalized AER of the resilient member according to Verification Example 7 was 0.047 J/cm$^3$ when the energy return rate was assumed to be 80%. The normalized AER of the resilient member according to Verification Example 7 exceeded the normalized AER of the shock absorber according to Comparative Example 2, and it was confirmed that high resilience performance could be achieved by the resilient member 1B configured as described above.

Further, it was calculated that the buckling start point of the resilient member according to Verification Example 7 was located at a point at which the stress σ was 0.123 MPa and the strain c was 18%. In other words, it was confirmed that the buckling start point of the resilient member according to Verification Example 7 was within both the required stress range and the required strain range.

<Summary of Verification Test 5>

Based on the result of Verification Test 5 as described above, it is understood that resilient force higher than that in the conventional art can be achieved by a resilient member: configured to have a three-dimensional shape formed by a wall having an outer shape defined by a pair of parallel curved surfaces such that the resilient member may buckle when it receives compression force; and also configured to start buckling within the required strain range and the required stress range when a load is applied to the resilient member in a gradually increasing manner.

Therefore, when the resilient member is designed such that buckling is started within the required strain range and the required stress range described above, high resilient force is achieved By applying this resilient member to a shoe sole, a shoe sole and a shoe capable of achieving high propulsive force during running can be obtained. In other words, by applying the above-described resilient member 1B as the resilient member 1 included in each of the shoe soles 110A to 110H according to the above-described embodiment and the modifications thereof, a shoe sole excellent in running performance and a shoe including the shoe sole can be obtained.

In this case, while the resilient member 1B described above has the unit structure body U formed by adding a thickness to each of divided structure units obtained by dividing a structure unit having the Schwartz P structure into two in the height direction, examples applicable as a structure unit of other triply periodic minimal surfaces may be a gyroid structure and a Schwartz D structure. By configuring a resilient member by adding a thickness to each of divided structure units obtained by dividing the above-mentioned structure unit into two in one of the orthogonal three-axis directions, a resilient member capable of achieving high resilient force can be obtained.

<Shoe Sole and Shoe according to Eighth and Ninth Modifications>

(Eighth Modification)

Figure 30:
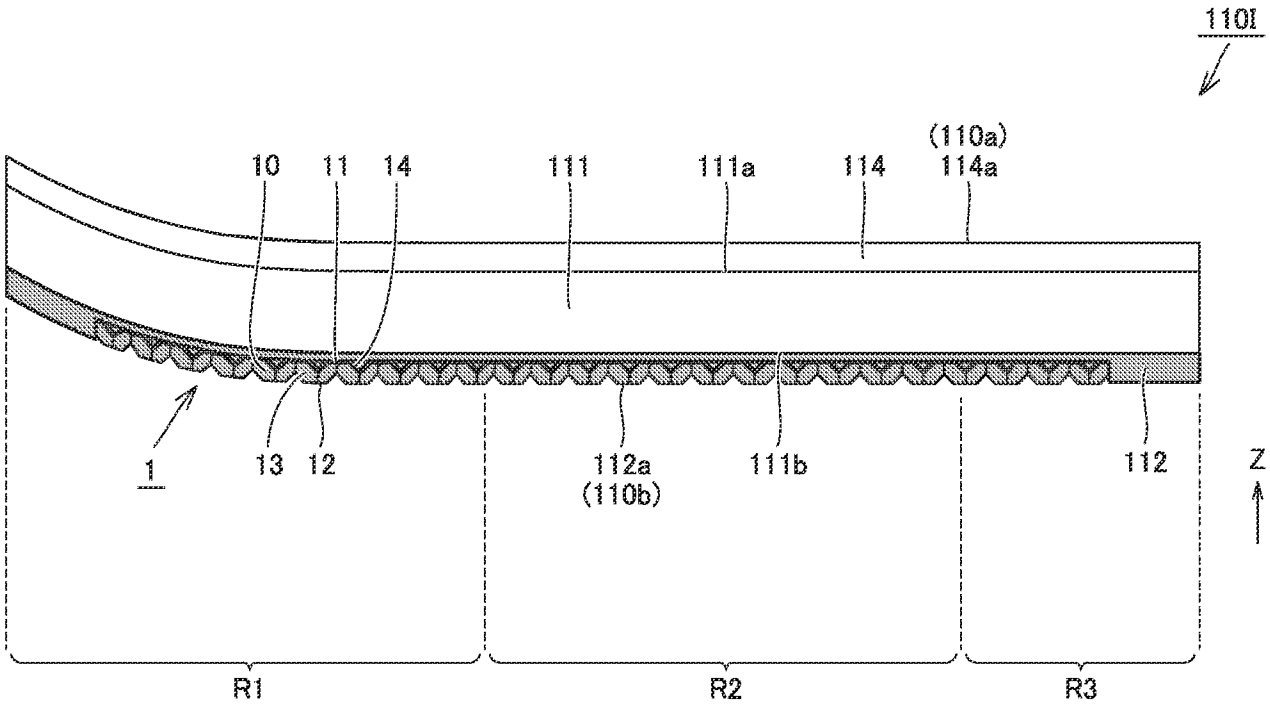
FIG. 30 is a schematic side view of a shoe sole according to an eighth modification when viewed from the lateral foot side.
Figure 31:
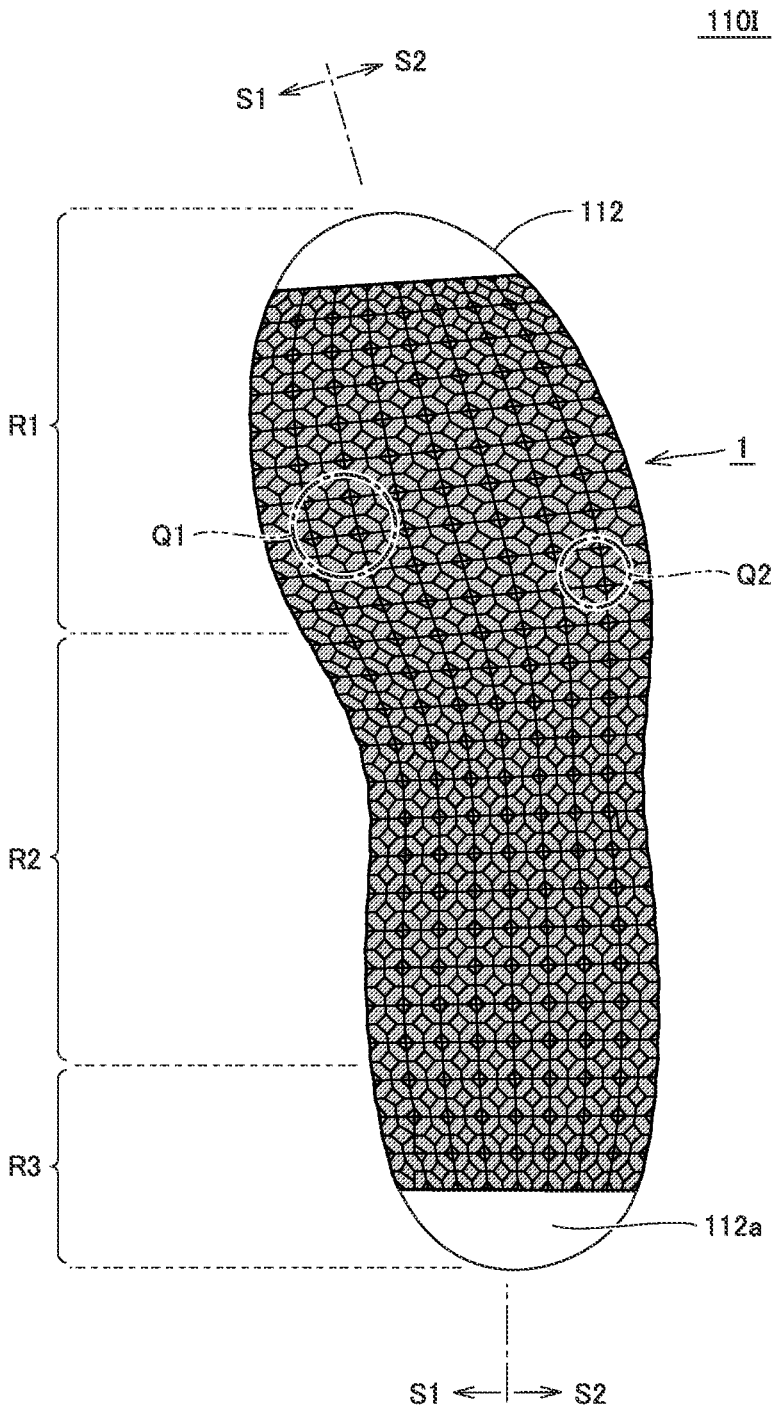
FIG. 31 is a schematic bottom view of an outsole included in the shoe sole shown in FIG. 30.

FIG. 30 is a side view of a shoe sole according to the eighth modification when viewed from the lateral foot side. FIG. 31 is a schematic bottom view of an outsole included in the shoe sole. Referring to FIGS. 30 and 31, the following describes a shoe sole 110I according to the eighth modification based on the above-described embodiment. In place of the shoe sole 110A according to the above-described embodiment, the shoe sole 110I according to the eighth modification is included in the shoe 100.

As shown in FIG. 30, the shoe sole 110I according to the eighth modification includes a midsole 11 and an outsole 112 as in the shoe sole 110A according to the above-described embodiment, but is different from the shoe sole 110A according to the above-described embodiment in that the highly rigid plate 113 (see FIG. 16 and the like) is not provided and a sockliner 114 is provided.

Specifically, the shoe sole 110I according to the eighth modification includes the midsole 111 and the outsole 112 as a shoe sole body, and the sockliner 114. In the shoe sole 110I, a part of the outsole 112 forms the resilient member 1. In other words, in the shoe sole 110I, a resilient member formed of a single member is not provided, but instead, a part of the outsole 112 is configured to function as a resilient member.

The midsole 111 extends in the front-rear direction from the forefoot portion R1 through the midfoot portion R2 to the rearfoot portion R3. The midsole 111 is made of a material lower in rigidity than the material forming the outsole 112 also serving as the resilient member 1, and has a substantially flat shape having an upper surface 111*a* and a lower surface 111*b*.

As shown in FIGS. 30 and 31, the outsole 112 extends in the front-rear direction from the forefoot portion R1 through the midfoot portion R2 to the rearfoot portion R3, and is bonded to the lower surface 111*b* of the midsole 111, for example, with an adhesive or the like so as to cover the lower surface 111*b* of the midsole 111. The outsole 112 having a substantially flat shape has a lower surface defining a ground contact surface 112*a* as a bottom surface 110*b* of the shoe sole 110I.

A portion functioning as the above-described resilient member 1 is provided at a prescribed position on the lower surface of the outsole 112. In order to facilitate understanding, this portion is shown in dark color in the figure. The portion functioning as the resilient member 1 in the outsole 112 has a three-dimensional shape formed by a wall 10 having an outer shape defined by a pair of parallel flat surfaces, and includes a plurality of upper wall portions 11, a plurality of lower wall portions 12, and a plurality of upright wall portions 13 described above. Thereby, the portion functioning as the resilient member 1 in the outsole 112 is located so as to be exposed to the outside in the portion of the shoe sole 110I on the bottom surface 110*b* side. A plurality of opened portions 14 are located on the side portion of the outsole 112 in the portion functioning as the resilient member 1.

In this case, the portion functioning as the resilient member 1 in the outsole 112 is provided in the substantially entire area of the ground contact surface 112*a* of the outsole 112, excluding the front-end-side portion of the forefoot portion R1 and the rear-end-side portion of the rearfoot portion R3, and is located to include a portion Q1 that supports a ball of the wearer's foot and a portion Q2 that supports a hypothenar of the wearer's foot.

The outsole 112 can be made of thermoplastic elastomer or rubber, and can be manufactured, for example, by molding such as injection molding using a mold, cast molding, sheet molding; additive manufacturing using a three-dimensional additive manufacturing apparatus; or the like.

As shown in FIG. 30, the sockliner 114 extends in the front-rear direction from the forefoot portion R1 through the midfoot portion R2 to the rearfoot portion R3, and is located so as to cover the upper surface 111*a* of the midsole 111. The sockliner 114 having a substantially flat shape has an upper surface 114*a* defining a top surface 110*a* of the shoe sole 110I.

The sockliner 114 is detachably provided on the upper surface 111*a* of the midsole 111, and more specifically, is inserted into a space inside the upper 120 and thereby disposed on the upper surface 111*a* of the midsole 111. The material of the sockliner 114 is not particularly limited, and the sockliner 114 can be made of various types of resin materials, rubber materials, or the like.

In the shoe sole 110I described above, the resilient member 1 is formed of a part of the outsole 112 as described above. Thus, based on the high resilience performance achieved by the portion functioning as the resilient member 1 in the outsole 112, the resilient force of the resilient member 1 is applied to the wearer's foot when the wearer's foot pushes off from the ground. Therefore, the configuration as described above can achieve high propulsive force, and thus, the shoe sole 110I excellent in running performance and the shoe 100 including the shoe sole 110I can be obtained.

(Ninth Modification)

Figure 32:
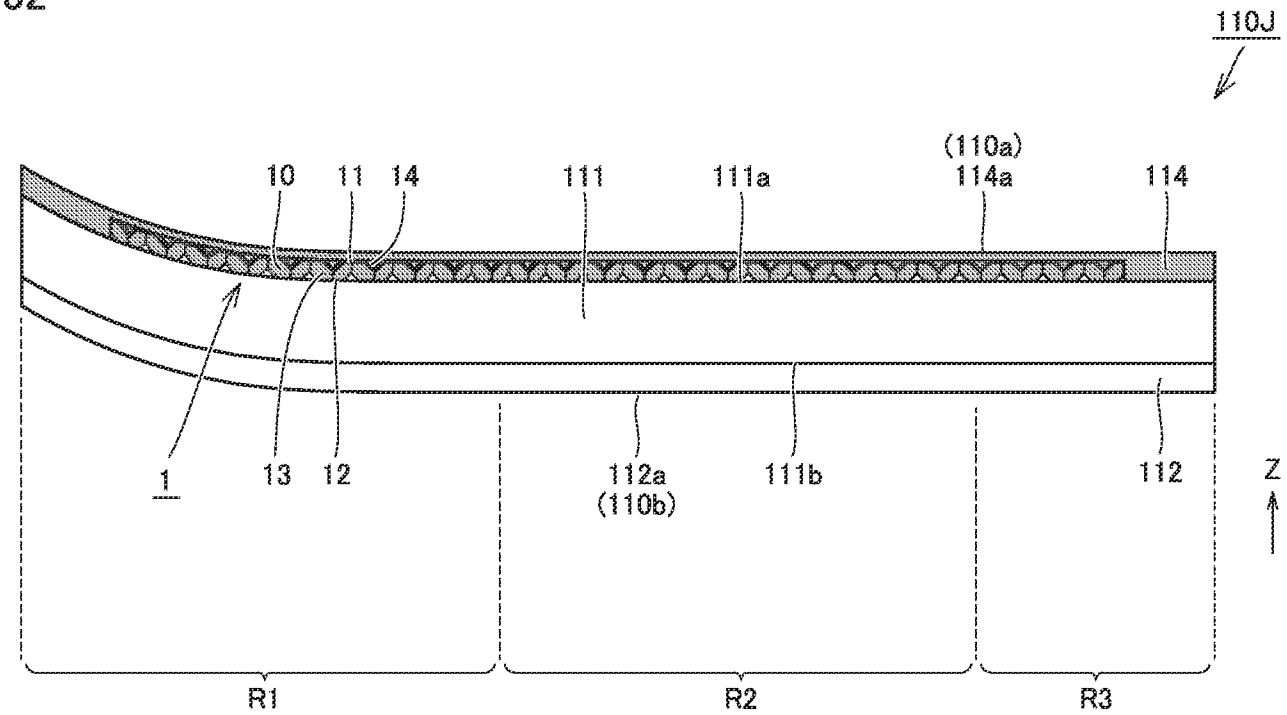
FIG. 32 is a schematic side view of a shoe sole according to a ninth modification when viewed from the lateral foot side.
Figure 33:
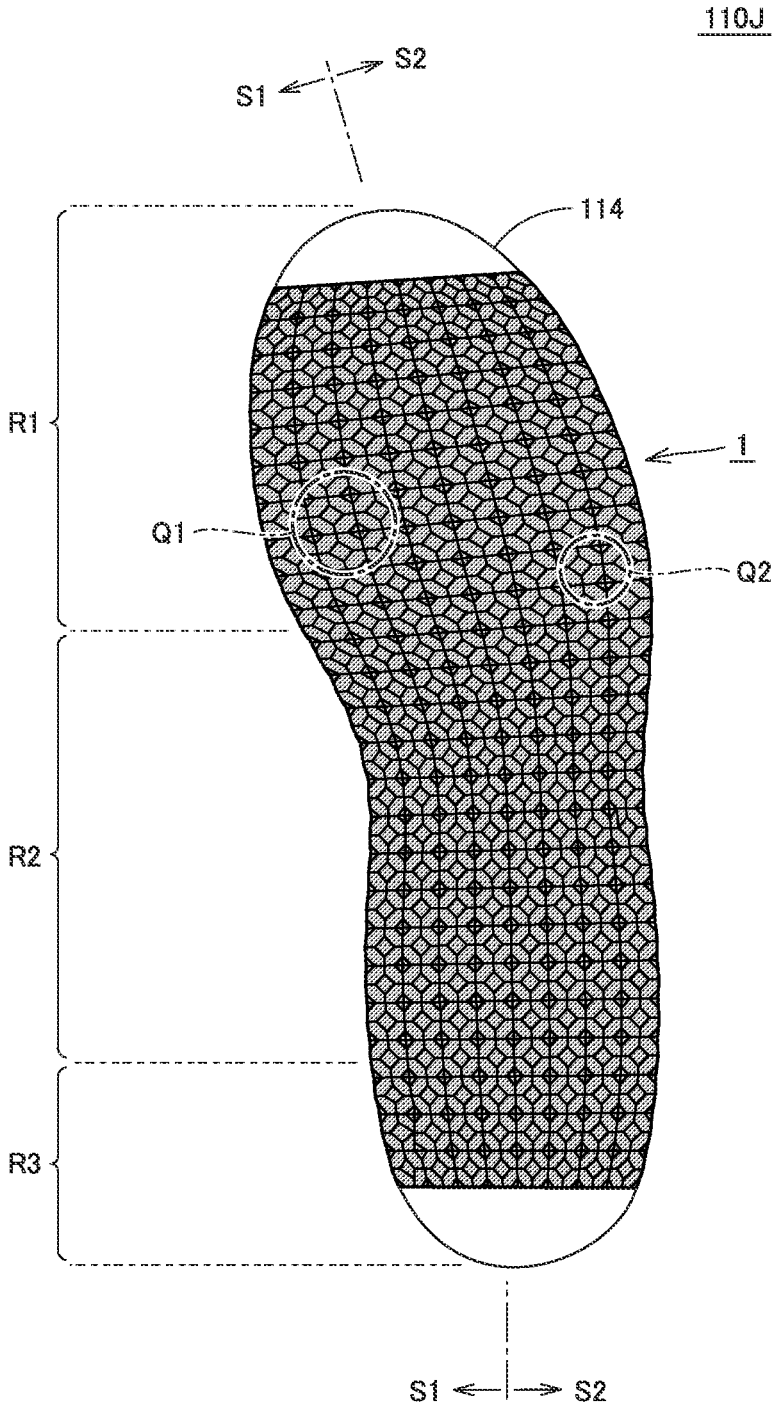
FIG. 33 is a schematic bottom view of a sockliner included in the shoe sole shown in FIG. 32.

FIG. 32 is a side view of a shoe sole according to the ninth modification when viewed from the lateral foot side FIG. 33 is a schematic bottom view of a sockliner included in the shoe sole. Referring to FIGS. 32 and 33, the following describes a shoe sole 110J according to the ninth modification based on the above-described embodiment. In place of the shoe sole 110A according to the above-described embodiment, the shoe sole 110J according to the ninth modification is included in the shoe 100.

As shown in FIG. 32, the shoe sole 110J according to the ninth modification includes a midsole 11 and an outsole 112 as in the shoe sole 110A according to the above-described embodiment, but is different from the shoe sole 110A according to the above-described embodiment in that the highly rigid plate 113 (see FIG. 16 and the like) is not provided and the sockliner 114 is provided.

Specifically, the shoe sole 110J according to the ninth modification includes the midsole 111 and the outsole 112 as a shoe sole body, and the sockliner 114. In the shoe sole 110J, a part of the sockliner 114 forms the resilient member 1. In other words, in the shoe sole 110J, a resilient member formed of a single member is not provided, but instead, a part of the sockliner 114 is configured to function as a resilient member.

The midsole 111 extends in the front-rear direction from the forefoot portion R1 through the midfoot portion R2 to the rearfoot portion R3. The midsole 111 is made of a material lower in rigidity than the material forming the sockliner 114 also serving as the resilient member 1, and has a substantially flat shape having an upper surface 111*a* and a lower surface 111*b*.

The outsole 112 extends in the front-rear direction from the forefoot portion R1 through the midfoot portion R2 to the rearfoot portion R3, and is bonded to the lower surface 111*b* of the midsole 111, for example, with an adhesive or the like so as to cover the lower surface 111*b* of the midsole 111. The outsole 112 having a substantially flat shape has a lower surface defining a ground contact surface 112*a* as a bottom surface 110*b* of the shoe sole 110J. The material of the outsole 112 is not particularly limited, and the outsole 112 can be made of various types of resin materials, rubber materials, or the like.

As shown in FIGS. 32 and 33, the sockliner 114 extends in the front-rear direction from the forefoot portion R1 through the midfoot portion R2 to the rearfoot portion R3, and is located so as to cover the upper surface 111*a* of the midsole 111. The sockliner 114 having a substantially flat shape has an upper surface 114*a* defining a top surface 110*a* of the shoe sole 110J.

The sockliner 114 is detachably provided on the upper surface 111*a* of the midsole 111, and more specifically, is inserted into a space inside the upper 120 and thereby disposed on the upper surface 111*a* of the midsole 111.

A portion functioning as the above-described resilient member 1 is provided at a prescribed position on the lower surface of the sockliner 114. In order to facilitate understanding, this portion is shown in dark color in the figure. The portion functioning as the resilient member 1 in the sockliner 114 has a three-dimensional shape formed by a wall 10 having an outer shape defined by a pair of parallel flat surfaces, and includes a plurality of upper wall portions 11, a plurality of lower wall portions 12, and a plurality of upright wall portions 13 described above. In addition, a plurality of opened portions 14 exposed to the outside are located on the side portion of the sockliner 114 in the portion functioning as the resilient member 1.

In this case, the portion functioning as the resilient member 1 in the sockliner 114 is provided in the substantially entire area of the lower surface of the sockliner 114, excluding the front-end-side portion of the forefoot portion R1 and the rear-end-side portion of the rearfoot portion R3, and is located to include a portion Q1 that supports a ball of the wearer's foot and a portion Q2 that supports a hypothenar of the wearer's foot.

The sockliner 114 can be made of thermoplastic elastomer or rubber, and can be manufactured, for example, by molding such as injection molding using a mold, cast molding, sheet molding; additive manufacturing using a three-dimensional additive manufacturing apparatus, or the like.

In the shoe sole 110J described above, the resilient member 1 is formed of a part of the sockliner 114 as described above. Thus, based on the high resilience performance achieved by the portion functioning as the resilient member 1 in the sockliner 114, the resilient force of the resilient member 1 is applied to the wearer's foot when the wearer's foot pushes off from the ground. Therefore, the configuration as described above can achieve high propulsive force, and thus, the shoe sole 110J excellent in running performance and the shoe 100 including the shoe sole 110J can be obtained.

<Summary of the Disclosure in Embodiment and the Like>

The following summarizes the characteristic configurations disclosed in the embodiment and the modifications thereof as described above.

A shoe sole according to an aspect of the present disclosure includes a resilient member and has a bottom surface serving as a ground contact surface and a top surface located opposite to the bottom surface. The resilient member has a three-dimensional shape formed by a wall having an outer shape defined by a pair of parallel flat or curved surfaces, and may buckle when the resilient member receives a compressive stress applied in a normal direction to the bottom surface. In the shoe sole according to an aspect of the present disclosure, when a load is applied to the shoe sole in a gradually increasing manner such that a compressive stress is applied to the resilient member in the normal direction, the resilient member starts to buckle in a state in which a stress applied to the resilient member is within a range of 0.05 MPa or more and 0.55 MPa or less and a strain of the resilient member in the normal direction is within a range of 10% or more and 60% or less.

In the shoe sole according to an aspect of the present disclosure, the resilient member may be disposed at least in a portion that supports a ball of a foot of a wearer.

In the shoe sole according to an aspect of the present disclosure, the resilient member may be disposed at least in a portion that supports a hypothenar of a foot of a wearer.

In the shoe sole according to an aspect of the present disclosure, the resilient member may be formed of a three-dimensional structure including a unit structure body having a three-dimensional shape formed by the wall, and the three-dimensional structure is configured by a plurality of the unit structure bodies repeatedly arranged in a regular and continuous manner at least in a direction intersecting with the normal direction.

In the shoe sole according to an aspect of the present disclosure, the unit structure body may be formed by adding a thickness to each of divided structure units obtained by dividing a structure unit into two in one of orthogonal three-axis directions, the structure unit being formed of a plurality of flat surfaces disposed to intersect with each other so as to be hollow inside.

In the shoe sole according to an aspect of the present disclosure, the structure unit may have one of a Kelvin structure, an octet structure, a cubic structure, and a cubic-octet structure.

In the shoe sole according to an aspect of the present disclosure, the unit structure body may be formed by adding a thickness to each of divided structure units obtained by dividing a structure unit having a triply periodic minimal surface into two in one of orthogonal three-axis directions.

In the shoe sole according to an aspect of the present disclosure, the structure unit may have one of a Schwartz P structure, a gyroid structure, and a Schwartz D structure.

The shoe sole according to an aspect of the present disclosure may further include: a midsole formed of a material lower in rigidity than a material forming the resilient member, the midsole including an upper surface defining the top surface; and an outsole covering a lower surface of the midsole and defining the bottom surface. In this case, the resilient member may be embedded in the midsole such that an upper surface of the resilient member defines the top surface and a lower surface of the resilient member reaches the outsole.

The shoe sole according to an aspect of the present disclosure may further include: a midsole formed of a material lower in rigidity than a material forming the resilient member, the midsole including an upper surface defining the top surface; and a highly rigid plate formed of a material higher in rigidity than a material forming the midsole. In this case, the highly rigid plate may be embedded in the midsole to extend in a direction intersecting with the normal direction. Also in this case, the resilient member may be embedded in the midsole such that an upper surface of the resilient member defines the top surface and a lower surface of the resilient member reaches the highly rigid plate.

The shoe sole according to an aspect of the present disclosure may further include: a midsole formed of a material lower in rigidity than a material forming the resilient member, the midsole including an upper surface defining the top surface; an outsole covering a lower surface of the midsole and defining the bottom surface; and a highly rigid plate formed of a material higher in rigidity than a material forming the midsole. In this case, the highly rigid plate may be embedded in the midsole to extend in a direction intersecting with the normal direction. Also in this case, the resilient member may be embedded in the midsole such that an upper surface of the resilient member reaches the highly rigid plate and a lower surface of the resilient member reaches the outsole.

The shoe sole according to an aspect of the present disclosure may further include: a midsole formed of a material lower in rigidity than a material forming the resilient member, the midsole including an upper surface defining the top surface; an outsole covering a lower surface of the midsole and defining the bottom surface; and an upper highly rigid plate and a lower highly rigid plate each formed of a material higher in rigidity than a material forming the midsole. In this case, the upper highly rigid plate may be disposed to cover the upper surface of the midsole so as to extend in a direction intersecting with the normal direction, and the lower highly rigid plate may be disposed to cover the lower surface of the midsole so as to extend in a direction intersecting with the normal direction. Also in this case, the resilient member may be embedded in the midsole such that an upper surface of the resilient member reaches the upper highly rigid plate and a lower surface of the resilient member reaches the lower highly rigid plate.

The shoe sole according to an aspect of the present disclosure may include: a midsole formed of a material lower in rigidity than a material forming the resilient member; and an outsole covering a lower surface of the midsole and defining the bottom surface. In this case, the resilient member may be formed of at least a part of the outsole.

The shoe sole according to an aspect of the present disclosure may include: a midsole formed of a material lower in rigidity than a material forming the resilient member; and a sockliner covering an upper surface of the midsole and defining the top surface. In this case, the resilient member may be formed of at least a part of the sockliner.

A shoe according to an aspect of the present disclosure includes, the shoe sole according to an aspect of the above-described present disclosure; and an upper provided above the shoe sole.

<Other Embodiments>

The above embodiment and the modifications thereof have been described with reference to an example in which a resilient member is provided in a part of a shoe sole including a midsole and an outsole, but the shoe sole may be entirely formed of a resilient member or a resilient member may be provided in a shoe sole not including a midsole or an outsole.

Further, the above embodiment and the modifications thereof have been described with reference to an example in which the resilient member is configured to have not only an upright wall portion but also an upper wall portion and a lower wall portion, but the resilient member may be configured not to have one of the upper wall portion and the lower wall portion or not to have both the upper wall portion and the lower wall portion. In other words, since buckling that improves the resilience performance occurs mainly in the upright wall portion, the upper wall portion and the lower wall portion are not essential components as long as the resilient member can be installed into a shoe sole in some way.

Further, the above embodiment and the modifications thereof have been described with reference to a shoe sole configured to have only one resilient member, but a plurality of resilient members may be separately provided in a shoe sole.

Further, the above embodiment and the modifications thereof have been described with reference to an example in which a resilient member is formed by adding a thickness to each of divided structure units obtained by dividing a structure unit having a geometrical surface structure into two in one of the orthogonal three-axis directions, but the resilient member does not necessarily have to be configured in this way. In other words, any resilient member may be applicable as long as the resilient member is configured to have a three-dimensional shape formed by a wall having an outer shape defined by a pair of parallel flat or curved surfaces, and the resilient member buckles within the required stress range and the required strain range as described above. Further, even when a resilient member is formed by adding a thickness to each of divided structure units obtained by dividing a structure unit having a geometrical surface structure into two in one of the orthogonal three-axis directions, modifications such as chamfering a corner portion, changing the thickness in each part, or slightly changing the shape of the unit structure body may be performed as appropriate.

Further, the above embodiment and the modifications thereof have been described with reference to an example in which the present invention is applied to a shoe including a shoe tongue and a shoelace, but the present invention may also be applicable to a shoe not including a shoe tongue and a shoelace (for example, a shoe including a sock-shaped upper) and a shoe sole included in the shoe.

Further, the characteristic configurations disclosed in the embodiment and the modifications thereof described above can be combined with each other without departing from the gist of the present invention.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A shoe sole comprising:

a resilient member; and a bottom surface configured as a ground contact surface, and a top surface located opposite to the bottom surface, wherein the resilient member has a three-dimensional shape configured by a wall having an outer shape defined by a pair of opposed flat or curved surfaces, the wall consisting of a plurality of upright wall portions, one upper wall portion, and a plurality of divided lower wall portions, each of the upright wall portions extending to intersect the upper wall portion and a corresponding one of the plurality of lower wall portions, the upright wall portions, the upper wall portion, and the lower wall portions each having a surface area that is entirely continuous, the resilient member is sandwiched between the top surface and the bottom surface such that the upper wall portion engages the top surface and the lower wall portions engage the bottom surface, the resilient member is configured to buckle when the resilient member receives a compressive stress applied in a normal direction to the bottom surface, and when a load is applied to the shoe sole in a gradually increasing manner such that a compressive stress is applied to the resilient member in the normal direction, the resilient member is configured to start to buckle when a stress applied to the resilient member is within a range of from 0.05 MPa to 0.55 MPa and a strain of the resilient member in the normal direction is within a range of from 10% to 60%.

2. The shoe sole according to claim 1, wherein the resilient member is disposed at least in a portion that is configured to support a ball of a foot of a wearer.

3. The shoe sole according to claim 1, wherein the resilient member is disposed at least in a portion that is configured to support a hypothenar of a foot of a wearer.

4. The shoe sole according to claim 1, wherein the resilient member is configured of a three-dimensional structure including a unit structure body having a three-dimensional shape configured by the wall, and the three-dimensional structure is configured by a plurality of the unit structure bodies repeatedly arranged in a regular and continuous manner at least in a direction intersecting with the normal direction.

5. The shoe sole according to claim 4, wherein the unit structure body is formed by adding a thickness to each of a plurality of divided structure units obtained by dividing each structure unit of the plurality of divided structure units into two units in at least one orthogonal three-axis direction, the structure unit being formed of a plurality of flat surfaces disposed to intersect with each other and be hollow inside.

6. The shoe sole according to claim 5, wherein the structure unit has one of a Kelvin structure, an octet structure, a cubic structure, and a cubic-octet structure.

7. The shoe sole according to claim 4, wherein the unit structure body is formed by adding a thickness to each of a plurality of divided structure units having a triply periodic minimal surface into two units in at least one orthogonal three-axis direction.

8. The shoe sole according to claim 7, wherein the structure unit has one of a Schwartz P structure, a gyroid structure, and a Schwartz D structure.

9. The shoe sole according to claim 1, further comprising:

a midsole including a material lower in rigidity than a material of the resilient member, the midsole having an upper surface defining the top surface; and an outsole covering a lower surface of the midsole and defining the bottom surface, wherein the resilient member is embedded in the midsole such that an upper surface of the resilient member defines the top surface of the shoe sole and a lower surface of the resilient member reaches the outsole.

10. The shoe sole according to claim 1, further comprising:

a midsole including a material lower in rigidity than a material of the resilient member, the midsole having an upper surface defining the top surface; and a rigid plate including a material higher in rigidity than the material of the midsole, wherein the rigid plate is embedded in the midsole to extend in a direction intersecting with the normal direction, and the resilient member is embedded in the midsole such that an upper surface of the resilient member defines the top surface of the shoe sole and a lower surface of the resilient member reaches the rigid plate.

11. The shoe sole according to claim 1, further comprising:

a midsole including a material lower in rigidity than a material of the resilient member, the midsole having an upper surface defining the top surface;

an outsole covering a lower surface of the midsole and defining the bottom surface; and a rigid plate including a material higher in rigidity than the material of the midsole, wherein the rigid plate is embedded in the midsole to extend in a direction intersecting with the normal direction, and the resilient member is embedded in the midsole such that an upper surface of the resilient member reaches the rigid plate and a lower surface of the resilient member reaches the outsole.

12. The shoe sole according to claim 1, further comprising:

a midsole including a material lower in rigidity than a material of the resilient member, the midsole having an upper surface defining the top surface;

an outsole covering a lower surface of the midsole and defining the bottom surface; and an upper rigid plate and a lower rigid plate each including a material higher in rigidity than a material of the midsole, wherein the upper rigid plate is disposed to cover the upper surface of the midsole so as to extend in a direction intersecting with the normal direction, the lower rigid plate is disposed to cover the lower surface of the midsole so as to extend in a direction intersecting with the normal direction, and the resilient member is embedded in the midsole such that an upper surface of the resilient member reaches the upper rigid plate and a lower surface of the resilient member reaches the lower rigid plate.

13. The shoe sole according to claim 1, further comprising:

a midsole including a material lower in rigidity than a material of the resilient member; and an outsole covering a lower surface of the midsole and defining the bottom surface, wherein the resilient member is configured of at least a part of the outsole.

14. The shoe sole according to claim 1, further comprising:

a midsole including a material lower in rigidity than a material of the resilient member; and a sockliner covering an upper surface of the midsole and the sockliner defining the top surface of the shoe sole, wherein the resilient member is configured of at least a part of the sockliner.

15. A shoe comprising:

the shoe sole according to claim 1; and an upper above the shoe sole.

* * * * *